US012421729B2

(12) United States Patent
Francis et al.

(10) Patent No.: US 12,421,729 B2
(45) Date of Patent: Sep. 23, 2025

(54) SPIRAL STAIRCASE

(71) Applicants: Aaron Todd Francis, San Jose, CA (US); John C McCune, San Martin, CA (US)

(72) Inventors: Aaron Todd Francis, San Jose, CA (US); John C McCune, San Martin, CA (US)

( * ) Notice: Subject to any disclaimer, the term of this patent is extended or adjusted under 35 U.S.C. 154(b) by 633 days.

(21) Appl. No.: 17/835,227

(22) Filed: Jun. 8, 2022

(65) Prior Publication Data

US 2023/0399851 A1 Dec. 14, 2023

(51) Int. Cl.
*E04F 11/04* (2006.01)
*E04F 11/032* (2006.01)
*E04F 11/18* (2006.01)

(52) U.S. Cl.
CPC ..... *E04F 11/04* (2013.01); *E04F 11/032* (2013.01); *E04F 11/181* (2013.01)

(58) Field of Classification Search
CPC ..... E04F 11/04; E04F 11/032; E04F 11/181; E04F 11/006; E04F 11/066; E04F 11/068
See application file for complete search history.

(56) References Cited

U.S. PATENT DOCUMENTS 4,434,884 A * 3/1984 Kettle ..... B65G 21/18 198/328
5,213,191 A * 5/1993 Tahara ..... B66B 21/06 198/328
5,557,893 A 9/1996 Bowls
2005/0210776 A1* 9/2005 Mills ..... B64D 11/00 52/187
2005/0284044 A1* 12/2005 Ritchie ..... E04F 11/032 52/187
2007/0000191 A1 1/2007 Arnold

FOREIGN PATENT DOCUMENTS

DE 202013003089 U1 * 6/2013 ..... E04F 11/032

OTHER PUBLICATIONS

Translation of DE202013003089 (Year: 2013).*

* cited by examiner

*Primary Examiner* — Jessica L Laux
(74) *Attorney, Agent, or Firm* — MT HUNT LAW; Marcus T. Hunt

(57) ABSTRACT

A staircase is provided that includes a column and steps. Each step: is coupled to the column and extends outside of, and away from, the column; includes a tread surface; and can move longitudinally along the column. The staircase can transition to a plurality of states by an actuation system, including closed and open states. The closed state includes the steps positioned at the upper end with the tread surfaces of the plurality of steps oriented around the upper end and coplanar to a flooring surface of the upper floor. The opened state includes the steps positioned at varying distances longitudinally along the column from the upper end towards the lower end so as to form spiraling steps around the column between the upper and lower floors. The steps can move longitudinally along the column for positioning in the closed and opened states.

20 Claims, 20 Drawing Sheets

SPIRAL STAIRCASE

FIELD

The present disclosure relates generally to the field of staircases, and more particularly to spiral staircases.

BACKGROUND

Existing spiral staircases are fixed staircase structures having steps that spiral around a center pole or axis between two floors. The center pole is usually a solid pole or hollow tube. The spiral staircases typically have balusters that are fixed to the outside of the steps and that extend up to a handrailing. The spiral staircases are fixed in a sense that the spiral staircase structure as a whole remains fixed in place once installed. As a result, the defined space where the spiral staircase sits cannot practically be used for other purposes or to be cleared for additional space. The exposed passageway of spiral staircases can also be a potential hazard that is continuously present. For example, someone can accidently fall into the staircase, or a child too young to safely use the staircase can easily enter the staircase, etc. In addition, because spiral staircases are fixed and typically in plain sight, it is almost impossible to conceal or hide the existence of the staircase or the presence of another floor.

SUMMARY

In one aspect of the present disclosure, a staircase for traversing between an upper floor and a lower floor is provided. The staircase includes: a column having an upper end configured for positioning at the upper floor, a lower end configured for positioning at the lower floor, and an interior area; and a plurality of steps coupled to the column. Each step of the plurality of steps: is coupled to the column and extends outside of, and away from, the column; includes a respective tread surface; and is configured to move longitudinally along the column. The staircase is configured to transition to a plurality of states by an actuation system during operation. The plurality of states include a closed state and an opened state. The closed state includes the plurality of steps positioned at the upper end of the column with the tread surfaces of the plurality of steps oriented around the upper end of the column and configured to be coplanar to a flooring surface of the upper floor. The opened state includes the plurality of steps positioned at varying distances longitudinally along the column from the upper end towards the lower end so as to form spiraling steps around the column between the upper and lower floors. The plurality of steps is configured to move longitudinally along the column for positioning in the closed and opened states.

In an embodiment, the staircase further includes a plurality of linear guides coupled together to form the column. The interior area is between the plurality of linear guides. The plurality of linear guides extends longitudinally between the upper and lower ends of the column. The plurality of steps are coupled to the plurality of linear guides. Each step of the plurality of steps: is coupled to a respective linear guide of the plurality of linear guides and extends outside of, and away from, the respective linear guide; and is configured to move longitudinally along the respective linear guide. The opened state includes the plurality of steps positioned at varying distances longitudinally along the plurality of linear guides from the upper end of the column towards the lower end of the column so as to form spiraling steps around the column between the upper floor and the lower floor. The plurality of steps is configured to move longitudinally along the plurality of linear guides for positioning in the closed and opened states. In an embodiment, the plurality of linear guides includes a plurality of subsets of linear guides that form segments of the column. Each subset of the plurality of subsets of linear guides includes more than one linear guide coupled together by coupling elements positioned in the interior area of the column. The staircase further includes: an upper housing positioned in the interior area of the column and coupled to the plurality of subsets of linear guides at the upper end of the column; and a lower housing positioned in the interior area of the column and coupled to the plurality of subsets of linear guides at the lower end of the column. The plurality of subsets of linear guides are coupled together by the upper and lower housings such that gaps are formed between adjacent segments of the column. The gaps extend longitudinally along the adjacent segments between the upper and lower housings. In an embodiment, the staircase includes a lifting platform. The lifting platform includes: a coupling portion for coupling to the actuation system, wherein the coupling portion is positioned in the interior area of the column; a contacting portion for contacting and moving the plurality of steps longitudinally along the plurality of linear guides, wherein the contacting portion is positioned outside of the column and below the plurality of steps; and one or more spokes extending from the coupling portion to the contacting portion. Each of the one or more spokes extend through a respective one of the gaps formed between the adjacent segments of the column. The lifting platform is configured to move longitudinally along the column to contact and move the plurality of steps longitudinally along the plurality of linear guides so as to lift and lower the plurality of steps along the column. Each of the one or more spokes are configured to move within the respective one of the gaps formed between the adjacent segments when the lifting platform moves longitudinally along the column. In an embodiment, the staircase further includes: a plurality of stop elements for contacting the plurality of steps to limit movement of the plurality of steps longitudinally along the plurality of linear guides toward the lower end of the column, and a first linear actuator for moving the lifting platform longitudinally along the column, wherein the actuation system includes the first linear actuator. The plurality of stop elements are coupled to the plurality of linear guides and positioned on an exterior side of the column such that the movement of the plurality of steps along the plurality of linear guides toward the lower end of the column is limited at the varying distances that form the spiraling steps around the column. The first linear actuator is coupled to the upper housing and includes a first traveling member. The first traveling member is coupled to the coupling portion of the lifting platform and configured to move longitudinally within the interior area of the column so as to move the lifting platform longitudinally along the column. In an embodiment, the staircase further includes: a landing barrier coupled to one of the plurality of linear guides and positioned outside of the column; and a second linear actuator for moving the landing barrier longitudinally along the column. The actuation system includes the second linear actuator. The second linear actuator is coupled to the upper housing and includes a second traveling member. The second traveling member is configured to extend through one of the gaps formed between the adjacent segment, wherein the second traveling member is coupled to the landing barrier and configured to move longitudinally along the column so as to move the landing barrier longitudinally along the column. The closed state further includes the landing barrier positioned below the upper floor. The opened state further includes the landing barrier positioned above the upper floor so as to: enable entry into the staircase from the upper floor in a direction of the spiraling steps around the column; and prevent entry into the staircase from the upper floor in a direction opposite of the spiraling steps around the column. In an embodiment, the staircase further includes: an outer perimeter assembly, and a wall barrier configured to rotate toward and couple to the landing barrier when the staircase enters the opened state to serve as a safety barrier extending from the landing barrier to a nearby wall when the staircase is in the opened state. The outer perimeter assembly includes: a perimeter base having a top surface, a latch actuator and a plurality of latches coupled to the perimeter base, and a plurality of elongated members coupled to the perimeter base and configured to extend longitudinally from the perimeter base toward the lower floor. The latch actuator and the plurality of latches are positioned around the perimeter base. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The latch actuator and the plurality of latches includes: a latched state that secures the plurality of steps in position in the closed state; and an unlatched state that enables the plurality of steps to transition from the closed state to the opened state. The plurality of elongated members is configured to couple to the outer perimeter of the plurality of steps such that the plurality of steps are movable longitudinally along the column for positioning in the closed and opened states. The plurality of elongated members is positioned around the perimeter base and around the outer perimeter of the plurality of steps so as to form a side barrier around the outer perimeter of the spiraling steps when the staircase is in the opened state. The closed state further includes the wall barrier positioned against or within a nearby wall. The open state further includes the wall barrier positioned to align with the landing barrier and couple to the landing barrier. In an embodiment, the staircase further includes a lifting platform. The lifting platform includes: a coupling portion for coupling to the actuation system, a contacting portion for contacting and moving the plurality of steps longitudinally along the plurality of linear guides, and one or more spokes extending from the coupling portion to the contacting portion. The coupling portion is positioned in the interior area of the column. The contacting portion is positioned outside of the column and below the plurality of steps. Each of the one or more spokes extend through the column. The lifting platform is configured to move longitudinally along the column to contact and move the plurality of steps longitudinally along the plurality of linear guides so as to lift and lower the plurality of steps along the column. In an embodiment, the staircase further includes: a landing barrier coupled to one of the plurality of linear guides and positioned outside of the column; and a linear actuator for moving the landing barrier longitudinally along the column. The actuation system includes the linear actuator. The linear actuator is coupled to the column, positioned within the column, and includes a traveling member. The traveling member is configured to extend through the column. The traveling member is coupled to the landing barrier and configured to move longitudinally along the column so as to move the landing barrier longitudinally along the column. The closed state further includes the landing barrier positioned below the upper floor. The opened state further includes the landing barrier positioned above the upper floor so as to: enable entry into the staircase from the upper floor in a direction of the spiraling steps around the column; and prevent entry into the staircase from the upper floor in a direction opposite of the spiraling steps around the column. In an embodiment, the staircase further includes an outer perimeter assembly. The outer perimeter assembly includes: a perimeter base having a top surface, and a latch actuator and a plurality of latches coupled to the perimeter base. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The latch actuator and the plurality of latches are positioned around the perimeter base. The latch actuator and the plurality of latches include: a latched state that secures the plurality of steps in position in the closed state; and an unlatched state that enables the plurality of steps to transition from the closed state to the opened state. In an embodiment, the staircase further includes an outer perimeter assembly. The outer perimeter assembly includes: a perimeter base having a top surface, and a plurality of elongated members coupled to the perimeter base and configured to extend longitudinally from the perimeter base toward the lower floor. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The plurality of elongated members is configured to couple to the outer perimeter of the plurality of steps such that the plurality of steps are movable longitudinally along the column for positioning in the closed and opened states. The plurality of elongated members is positioned around the perimeter base and around the outer perimeter of the plurality of steps so as to form a side barrier around the outer perimeter of the spiraling steps when the staircase is in the opened state.

In an embodiment, the staircase further includes a lifting platform. The lifting platform includes: a coupling portion for coupling to the actuation system, wherein the coupling portion is positioned in the interior area of the column; a contacting portion for contacting and moving the plurality of steps longitudinally along the column, wherein the contacting portion is positioned outside of the column and below the plurality of steps; and one or more spokes extending from the coupling portion to the contacting portion. Each of the one or more spokes extend through the column. The lifting platform is configured to move longitudinally along the column to contact and move the plurality of steps along the column. In an embodiment, the staircase, further includes a landing barrier coupled to the column. The closed state further includes the landing barrier positioned below the upper floor. The opened state further includes the landing barrier positioned above the upper floor so as to: enable entry into the staircase from the upper floor in a direction of the spiraling steps around the column; and prevent entry into the staircase from the upper floor in a direction opposite of the spiraling steps around the column. In an embodiment, the staircase further includes an outer perimeter assembly. The outer perimeter assembly includes: a perimeter base having a top surface, and a latch actuator and a plurality of latches coupled to the perimeter base. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The latch actuator and the plurality of latches are positioned around the perimeter base. The latch actuator and the plurality of latches include: a latched state that secures the plurality of steps in position in the closed state; and an unlatched state that enables the plurality of steps to transition from the closed state to the opened state. In an embodiment, the staircase further includes an outer perimeter assembly. The outer perimeter assembly includes: a perimeter base having a top surface, and a plurality of elongated members coupled to the perimeter base and configured to extend longitudinally from the perimeter base toward the lower floor. The perimeter base is configured to be positioned in the upper floor such that the top surface is coplanar with the flooring surface of the upper floor. The he perimeter base is oriented around an outer perimeter of the plurality of steps such that the top surface is coplanar with the tread surfaces of the plurality of steps when the staircase is in the closed state. The plurality of elongated members is configured to couple to the outer perimeter of the plurality of steps such that the plurality of steps are movable longitudinally along the column for positioning in the closed and opened states. The plurality of elongated members is positioned around the perimeter base and around the outer perimeter of the plurality of steps so as to form a side barrier around the outer perimeter of the spiraling steps when the staircase is in the opened state.

In an embodiment, the staircase further includes a landing barrier coupled to the column. The closed state further includes the landing barrier positioned below the upper floor. The opened state further includes the landing barrier positioned above the upper floor so as to: enable entry into the staircase from the upper floor in a direction of the spiraling steps around the column; and prevent entry into the staircase from the upper. In an embodiment, the staircase further includes: an outer perimeter assembly. The outer perimeter assembly includes: a perimeter base having a top surface, a latch actuator and a plurality of latches coupled to the perimeter base, and a plurality of elongated members coupled to the perimeter base and configured to extend longitudinally from the perimeter base toward the lower floor. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The latch actuator and the plurality of latches are positioned around the perimeter base. The latch actuator and the plurality of latches include: a latched state that secures the plurality of steps in position in the closed state; and an unlatched state that enables the plurality of steps to transition from the closed state to the opened state. The plurality of elongated members is configured to couple to the outer perimeter of the plurality of steps such that the plurality of steps are movable longitudinally along the column for positioning in the closed and opened states. The plurality of elongated members is positioned around the perimeter base and around the outer perimeter of the plurality of steps so as to form a side barrier around the outer perimeter of the spiraling steps when the staircase is in the opened state. In an embodiment, the staircase further includes a wall barrier configured to rotate toward and couple to the landing barrier when the staircase enters the opened state to serve as a safety barrier extending from the landing barrier to a nearby wall when the staircase is in the opened state. The closed state further includes the wall barrier positioned against or within a nearby wall. The open state further includes the wall barrier positioned to align with the landing barrier and couple to the landing barrier.

In an embodiment, the staircase further includes an outer perimeter assembly. The outer perimeter assembly includes: a perimeter base having a top surface, and a latch actuator and a plurality of latches coupled to the perimeter base. The perimeter base is configured to be positioned in the upper floor such that the top surface is coplanar with the flooring surface of the upper floor. The perimeter base is oriented around an outer perimeter of the plurality of steps such that the top surface is coplanar with the tread surfaces of the plurality of steps when the staircase is in the closed state. The latch actuator and the plurality of latches are positioned around the perimeter base. The latch actuator and the plurality of latches include: a latched state that secures the plurality of steps in position in the closed state; and an unlatched state that enables the plurality of steps to transition from the closed state to the opened state. In an embodiment, the outer perimeter assembly further includes a plurality of elongated members coupled to the perimeter base and configured to extend longitudinally from the perimeter base toward the lower floor. The plurality of elongated members is configured to couple to the outer perimeter of the plurality of steps such that the plurality of steps are movable longitudinally along the column for positioning in the closed and opened states. The plurality of elongated members is positioned around the perimeter base and around the outer perimeter of the plurality of steps so as to form a side barrier around the outer perimeter of the spiraling steps when the staircase is in the opened state.

BRIEF DESCRIPTION OF THE DRAWINGS

A detailed description of various embodiments of the present disclosure is provided herein with reference to the accompanying drawings, which are briefly described below. The drawings are illustrative and are not necessarily drawn to scale. The drawings illustrate various embodiments of the present disclosure and may illustrate one or more embodiment(s) or example(s) of the present disclosure in whole or in part. A reference numeral, letter, and/or symbol that is used in one drawing to refer to a particular element may be used in another drawing to refer to a like element.

DETAILED DESCRIPTION

Figure 1B:
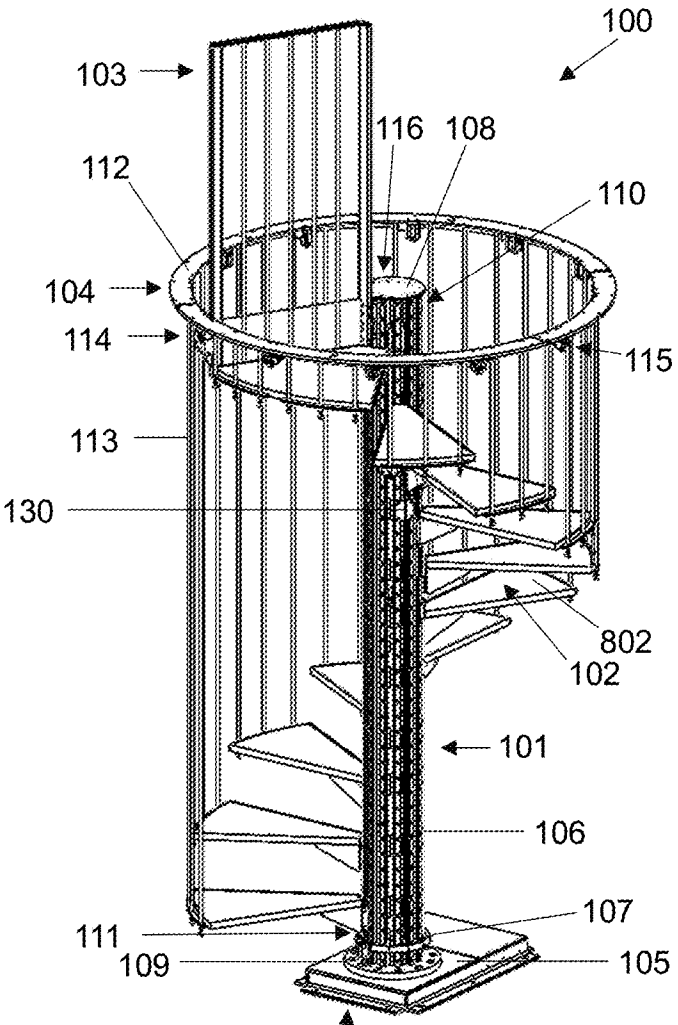
FIGS. 1A and 1B illustrate perspective views of an exemplary cascading spiral staircase in closed and opened states, respectively, according to an embodiment.

Before the present invention is described in greater detail, it is to be understood that this invention is not limited to particular embodiments described, as such can, of course, vary. It is also to be understood that the terminology used herein is for the purpose of describing particular embodiments only, and is not intended to be limiting, since the scope of the present invention will be limited only by the appended claims. Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges can independently be included in the smaller ranges and are also encompassed within the invention, subject to any specifically excluded limit in the stated range. Where the stated range includes one or both of the limits, ranges excluding either or both of those included limits are also included in the invention. Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described. It is noted that, as used herein and in the appended claims, the singular forms "a", "an", and "the" include plural referents unless the context clearly dictates otherwise. It is also noted that certain ordinal terms (e.g., "first" or "second") may be provided for ease of reference and do not necessarily imply physical characteristics or ordering. Therefore, as used herein, an ordinal term (e.g., "first," "second," "third," etc.) used to modify an element, such as a structure, a component, an operation, etc., does not necessarily indicate priority or order of the element with respect to another element, but rather distinguishes the element from another element having a same name (but for use of the ordinal term). Further, an operation performed "based on" a condition or event may also be performed based on one or more conditions, or events not explicitly recited. In addition, as used herein, "exemplary" may indicate an example, an implementation, and/or an aspect, and should not be construed as limiting or as indicating a preference or a preferred example, implementation, and/or aspect. Further, the description may use the term "coupled with," or "coupled to," along with its derivatives, may be used herein. "Coupled" may mean one or more of the following. "Coupled" may mean that two or more elements are in direct physical or electrical contact (or are directly connected). However, "coupled" may also mean that two or more elements indirectly contact each other (or are indirectly connected), but yet still cooperate or interact with each other, and may mean that one or more other elements are coupled between the elements that are said to be coupled with each other. Moreover, it is further noted that the claims may be drafted to exclude any optional element. As such, this statement is intended to serve as antecedent basis for use of such exclusive terminology as "solely," "only" and the like in connection with the recitation of claim elements, or use of a "negative" limitation. As will be apparent to those of skill in the art upon reading this disclosure, each of the individual embodiments described and illustrated herein has discrete components and features which can be readily separated from or combined with the features of any of the other several embodiments without departing from the scope or spirit of the present invention.

In one aspect of the present disclosure, a cascading spiral staircase is provided. The staircase includes a column with steps coupled to, and positioned around, the column. The column has an upper end configured for positioning at the upper floor, a lower end configured for positioning at the lower floor, and an interior area within the column. Each step is coupled to the column and extends outside of, and away from, the column. Each step includes a tread surface for walking on. And further, each step is configured to move longitudinally along the column. The staircase is configured to transition to various states during operation, including a closed state and an opened state. The steps are configured to move longitudinally along the column for positioning in the closed and opened states. In the opened state, the steps are positioned at varying distances longitudinally along the column from the upper end toward the lower end so as to form spiraling steps around the column between the upper and lower floors. In the opened state, users can enter and traverse the staircase to go between upper and lower floors of a building, dwelling, or other multiple-story structure for instance. In the closed state, the steps are positioned at the upper end of the column. The tread surfaces of the steps are oriented around the upper end of the column and configured to be coplanar (or flush) with the flooring surface of the upper floor. References to objects being "coplanar," "flush," "contiguous," may be made herein and should be construed to include being substantially or generally coplanar, flush, and contiguous, respectively. In the closed state, the steps form part of the flooring surface of the upper floor and close (or close off) the passageway between the upper and lower floors. The steps are configured to support a substantial load. Closing the passageway can be beneficial for a variety of reasons, such eliminating a potential hazard of an exposed passageway, creating an ability to restrict access to another floor, increasing the level of privacy between floors, reducing the level of noise between floors, etc. For example, privacy can be increased by concealing that a staircase is present, or by making the tread surfaces of the steps out of an opaque material or material that reduces visibility through the steps. In another embodiment, visibility through the steps may be desired and the tread surfaces can be made of a see-through material, such as tempered glass, to enable visibility between upper and lower floors through the steps. The flooring surface created by the steps can also be beneficial by freeing up additional floor space to use (e.g., walk on, stand on, etc.) in a room. In some instances it may be desirable to set up furniture on the additional floor space created by the staircase, such as when the staircase is to remain closed for extended periods of time.

In one aspect of the present disclosure, the staircase can include a landing barrier coupled to, and positioned outside of, the column. In the opened state, the landing barrier can be positioned above the upper floor so as to enable proper entry into the staircase from the upper floor in the direction of the spiraling steps around the column; and, prevent improper entry into the staircase from the upper floor in the direction opposite of the spiraling steps around the column. In an embodiment, the landing barrier can be positioned above the flooring surface of the upper floor with a portion of the landing barrier remaining below the flooring surface of the upper floor. In the closed state, the landing barrier can be positioned below the upper floor so as to avoid taking up space and creating an obstruction on the upper floor. The landing barrier can be positioned so that the top side of the landing barrier is coplanar with the tread surfaces of the steps and the flooring space on the upper floor.

In one aspect of the present disclosure, the staircase can include a wall barrier that is configured to couple to the landing barrier to serve as a safety barrier extending from the landing barrier to a nearby wall when the staircase is in the opened state. In the opened state, the wall barrier functions to prevent someone from walking around the landing barrier and potentially falling down the exposed passageway of the staircase. In an embodiment, the wall barrier can be configured to rotate against or within the nearby wall (e.g., within a recess in the nearby wall) when the staircase is in the closed state so as to avoid taking up space and creating an obstruction on the upper floor.

In one aspect of the present disclosure, the staircase can include an outer perimeter assembly that is positioned within a flooring surface of the upper floor and is configured to surround the steps of the staircase when in the closed state. The outer perimeter assembly can include a latch actuator and latches that function to latch (or lock, secure, etc.) and unlatch (or unlock, secure, etc.) the steps in the closed state position. The outer perimeter assembly can also include a perimeter base and elongated members (e.g., rods) that can extend from the perimeter base toward the lower floor. In the opened state position, the elongated members are positioned around the outer perimeter of the spiraling steps and function as a side barrier (or safety barrier) through the passageway of the staircase.

The figures and corresponding descriptions presented herein illustrate and describe exemplary embodiments to facilitate understanding of the underlying principles of the staircase of the present disclosure. The figures use reference numerals consistently to designate like parts, and thus the descriptions of one figure may be applicable to other figure. Furthermore, for the sake of clarity and brevity, every reference number for objects illustrated in one figure may not necessarily be repeated in every other figure.

Figure 1A:
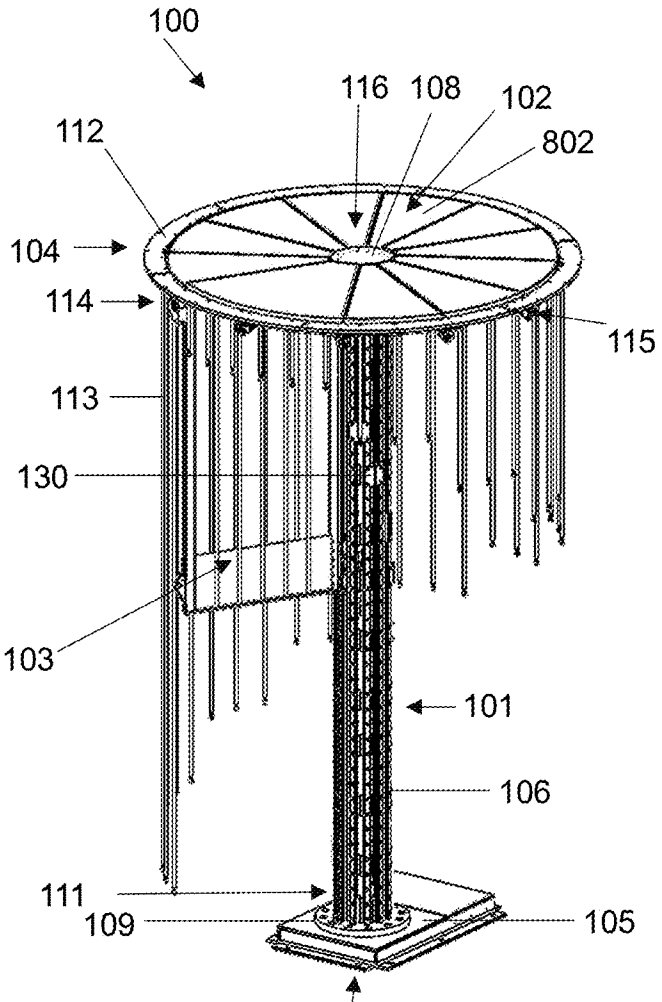

FIGS. 1A and 1B illustrate perspective views of an exemplary spiral staircase in closed and opened states, respectively, according to an embodiment. In FIGS. 1A and 1, a spiral staircase 100 is shown including a column 101, steps (of which step 102 is a representative step) coupled to the column 101 and having tread surfaces (of which tread surface 802 is a representative tread surface), a landing barrier 103 coupled to the column 101, an outer perimeter assembly 104 positioned around the column 101, and a base housing 105 coupled to the column 101. The column 101 is shown including linear guides (of which linear guide 106 is a representative linear guide) coupled together, a lifting platform 107 positioned around the linear guides 106, cover and base plates 108,109 coupled to ends of the column 101, upper and lower housings (or machine housings) 110,111 coupled to the ends of the column 101, and stop elements 130 coupled to the linear guides 106 on the outside (or exterior, exterior side, etc.) of the column 101. The outer perimeter assembly 104 is shown including a perimeter base 112, elongated members (of which elongated member 113 is a representative elongated member) coupled to and extending from the perimeter base 112, a latch actuator 114 coupled to the perimeter base 112 near the landing barrier 103, and a plurality of latches (of which latch 115 is a representative latch) coupled to and around the perimeter base 112.

The steps 102 are coupled to and around the column 101. The column 101 has an upper end 116 configured for positioning at the upper floor, a lower end 117 configured for positioning at the lower floor, and an interior area (not shown in FIGS. 1A and 1B) within the column 101. Each step 102 is coupled to a respective linear guide 106 and extends outside of, and away from, the column 101. Each step includes a tread surface 802 and is configured to move longitudinally along (or up and down) the column 101. The staircase 100 is configured to transition to a plurality of states during operation, including the closed state and the opened state. In an embodiment, the staircase 100 can be configured to transition between the opened and closed states in response to a user command or event from a user device, such as touchscreen display, button, lever, switch, etc. The steps 102 are configured to move longitudinally along (or up and down) the linear guides 106 for positioning in the closed and opened states. The outer perimeter assembly 104 is positioned within the flooring surface of the upper floor. The outer perimeter assembly 104 includes the latch actuator 114 and the latches 115, which function to latch (or lock, secure, etc.) and unlatch (or unlock, make unsecure (or not secured), etc.) the steps in the closed state position. The outer perimeter assembly 104 can also include a perimeter base 112 and elongated members (e.g., rods) 113 that can extend from the perimeter base 112 toward the lower floor.

In FIG. 1A, the staircase 100 is in the closed state. The steps 102 are oriented around an upper end 116 of the column with its tread surfaces 802 configured to be coplanar to a flooring surface of the upper floor. In the closed state, the steps 102 close (or close off) the passageway of the staircase 100 between upper and lower floors. In the closed state, the landing barrier 103 is configured to be positioned below the upper floor so as to avoid taking up space and creating an obstruction on the upper floor. The top of the landing barrier 103 can be coplanar with the tread surfaces 802 and the perimeter base 112. The landing barrier 103 can be positioned so that the top side of the landing barrier 103 is coplanar with the tread surfaces 802 of the steps 102, the perimeter base 112, and the flooring space on the upper floor. In an embodiment, the perimeter base 112, the steps 102, the top of the landing barrier 103, the cover plate 108, and the flooring surface of the upper floor are coplanar and contiguous. In an embodiment, in the closed state position, the elongated members 113 extend below the perimeter base 112 toward lower floor.

In FIG. 1B, the staircase 100 is in the opened state. In the opened state, the steps 102 are positioned at varying distances longitudinally along the column 101 from the upper end 116 toward the lower end 117 of the column 101 so as to form spiraling steps around the column 101 between the upper and lower floors. The "varying distances" can be measured, for instance, from the upper end 116 of the column 101, such as from the top of the linear guides 106 (or from the cover plate 108 that is configured to be coplanar with the flooring surface of the upper floor and the perimeter base 112) for instance. The upper floor can be coplanar with the perimeter base 112 and the tread surfaces 802 of the steps 102. The lower floor can be coplanar with the base plate 109 or with the base housing 105 (e.g., a top surface of the base housing) for instance. In the opened state, users can enter and traverse the staircase to go between upper and lower floors of a building, dwelling, or other multiple-story structure for instance. The landing barrier 103 is positioned above the upper floor so as to enable proper entry into the staircase 100 from the upper floor in the direction of the spiraling steps around the column; and, prevent improper entry into the staircase 100 from the upper floor in the direction opposite of the spiraling steps around the column. In the embodiment shown, the landing barrier is positioned above the flooring surface of the upper floor with a portion of the landing barrier remaining below the flooring surface of the upper floor. The elongated members 113 are positioned around the outer perimeter of the spiraling steps 102 and function as a side barrier (or safety barrier) through the passageway of the staircase 100.

Figure 2A:
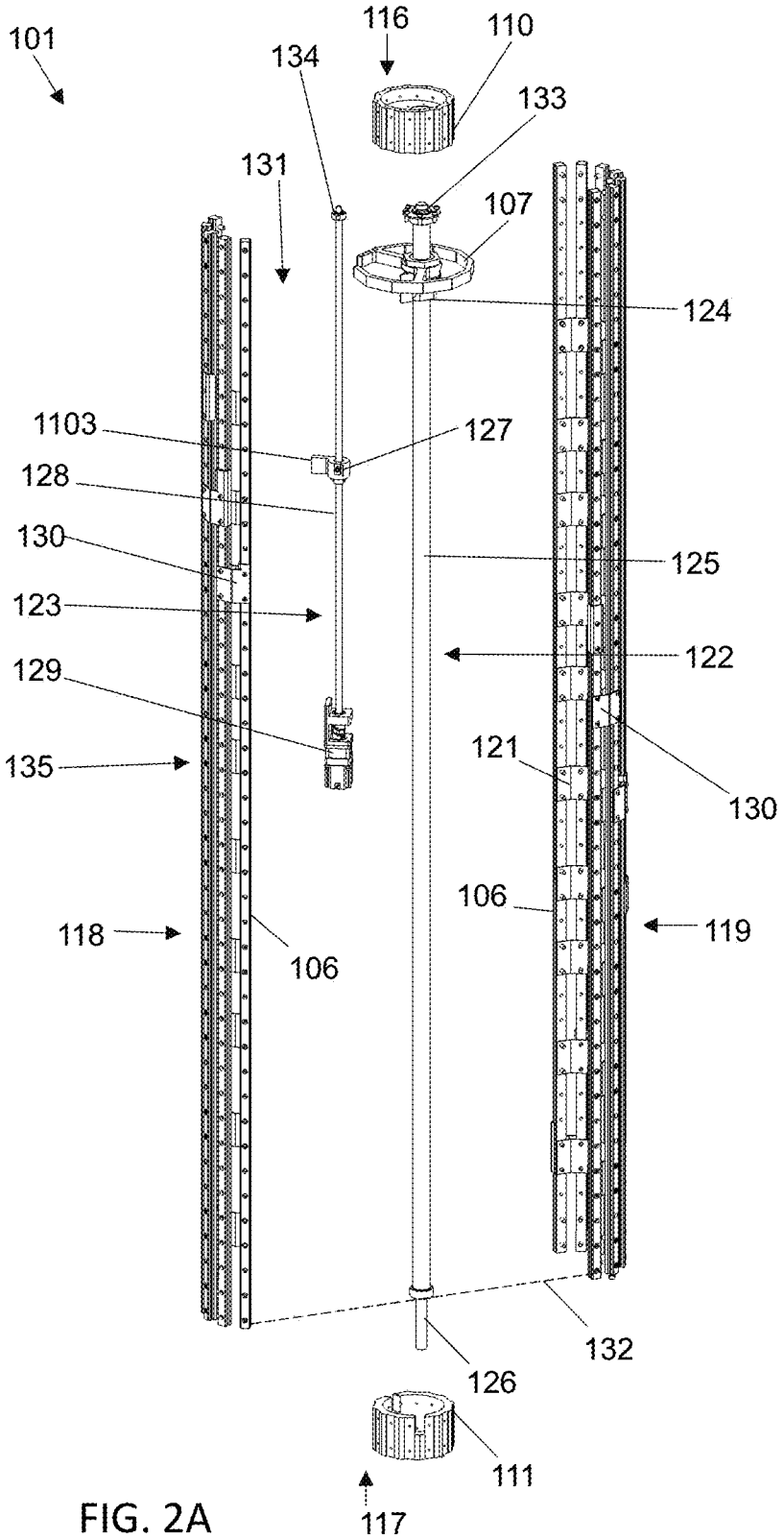
FIG. 2A illustrates a partially exploded view of the column 101 of FIG. 1, according to an embodiment.
Figure 2B:
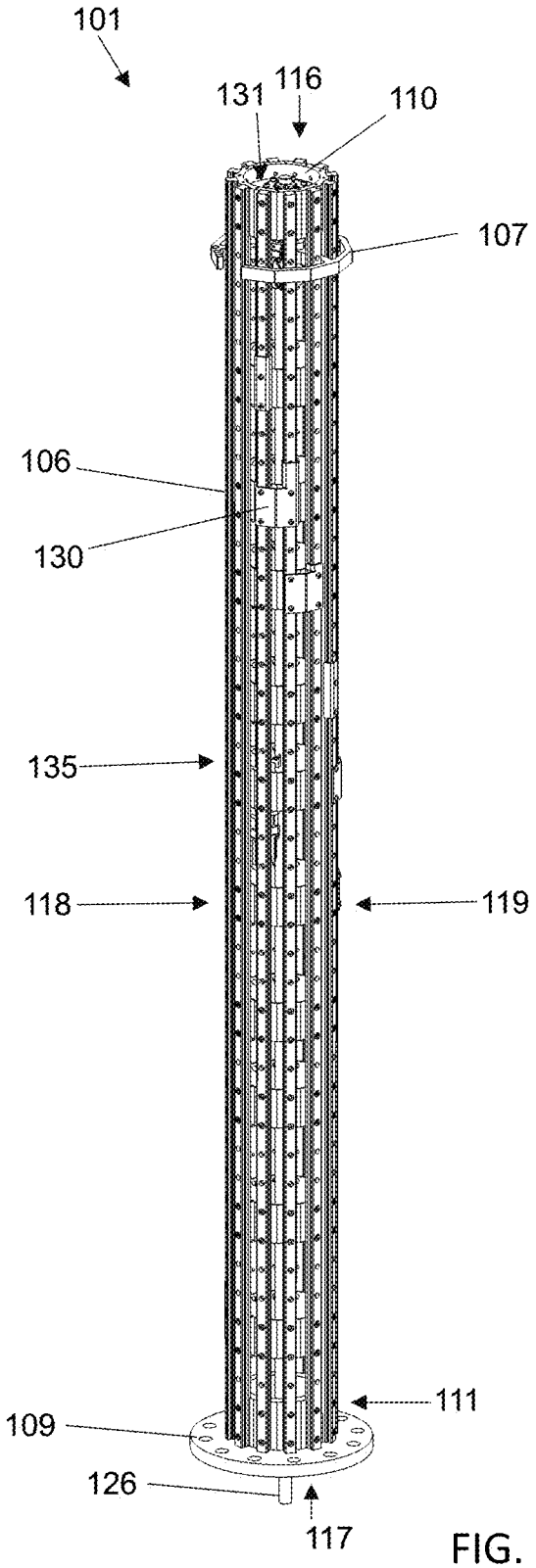
FIG. 2B illustrates a perspective view of the column 101 of FIG. 2A assembled, according to an embodiment.

FIG. 2A illustrates a partially exploded view of the column 101 of FIGS. 1A and 1, according to an embodiment. FIG. 2B illustrates a perspective view of the column 101 of FIG. 2A assembled, according to an embodiment. In FIGS. 2A and 2B, the column 101 includes the linear guides 106 coupled together to form the column 101. The column 101 includes the upper and lower ends 116,117 and a hollow interior area 131 formed by the linear guides 106. The column 101 extends longitudinally between the upper and lower ends 116,117 of the column 101, which are respectively positioned at floor level of the upper and lower floors. The linear guides 106 are elongated and extend longitudinally between the upper and lower ends 116,117 of the column 101. In the embodiment shown, the linear guides 106 are arranged vertically in a radial pattern to form a hollow cylinder having a substantially circular cross section. In other embodiments, the linear guides 106 can be arranged so as to form a column having a cross-sectional shape other than a circle, such as an ellipse, square, hexagon, octagon, etc. The column can have any number of sides in other embodiments. The sides may commonly coincide with the number of steps or the number of steps and landing barrier, but are not required to match the number of steps, be radial, or be equidistance. The column 101 shown includes twelve linear guides 106 that each couples to a respective one of eleven steps 102 and the landing barrier 103 (not shown in FIGS. 2A and 2B). For example, one reference linear guide 106 can be coupled to the landing barrier 103 while each successive linear guide 106 in a direction around the column 101 (e.g., clockwise or counter clockwise) can be coupled to each successive spiraling step 102 down the column 101 of the staircase 100. In this way, the reference linear guide 106 with the landing barrier 103 is adjacent to: the linear guide 106 coupled to an initial spiraled step 102 (or the first step from the upper floor), and the linear guide 106 coupled to a final spiraled step 102 (or the step closest to the lower floor). It should be appreciated that in other embodiments a different number of number of steps 102 can be implemented as desired, such as to accommodate varying distances between the upper and lower floors, varying distances (or heights) between the steps 102, etc.

The plurality of linear guides 106 are coupled together in multiple segments (e.g., the segments 118,119). Each segment 118,119 includes a subset of the linear guides 106. In the embodiment shown, the segment 119 is shown including seven linear guides 106 coupled together by coupling elements (of which coupling element 121 is a representative coupling element). The segment 118 is shown including five linear guides 106, which are also coupled together by coupling elements 121 (not shown in FIGS. 2A and 2B for the segment 118)121. The coupling elements 121 are shown as plates that are fastened (e.g., bolted or screwed) to the linear guides 106 from the interior area 131 (or from the inside, interior side, etc.) of the column 101 and shaped to accommodate the shape of the column 101. The segments (or the subsets of linear guides) 118,119 are coupled together by the upper and lower housings 110,111 such that gaps (of which gap 132 is a representative gap) are formed between the segments 118,119 of the column 101. The representative gap 132 is shown with dotted lines in FIG. 2A because of the partially exploded view. The dotted lines represent the "exploded" width of the gap 132. The gap 132 extends longitudinally along the segments 118,119 between the upper and lower housings. Another gap 132 is formed at the other end of the segments 118,119. Put another way, the gaps 132 extend longitudinally along the last linear guides 106 on the ends of the segments 118,119 between the upper and lower housings 110,111. In another embodiment having more than two segments, the gaps 132 can be formed between adjacent segments.

Within each segment 118,119, the stop elements 130 are coupled to the linear guides 106 on the outside of the column 101. The stop elements 130 are configured to limit (or stop) the movement of the steps 102 longitudinally along the linear guides 106 from the upper end 116 of the column 101 towards the lower end 117. The stop elements 130 are positioned such that the steps 102 are limited at varying distances longitudinally along the linear guides 106 from the upper end 116 of the column 101 toward the lower end 117 of the column 101 so as to form spiraling steps around the column 101 between the upper floor and the lower floor. For example, each of the steps 102 can be limited at the appropriate distance longitudinally along the linear guides 106 from the upper end 116 of the column 101 toward the lower end 117 of the column 101 to create the desired position and height of each step 102 on the column 101. Example distances between each step can vary based on various factors, such as user preference, height between floors, number of steps implemented, etc. Example distances between each step can include, but are not limited to, distances within the range of 5 inches to 15 inches, including 7 inches to 10 inches. In one implementation, the distance between each step is approximately 8.5 inches. The height between the steps 102 on any single flight (e.g., between the upper and lower floors) can be approximately (or substantially) the same in one implementation. The distance between each step can be derived, for example, by dividing the height between the upper and lower floors by the number of total steps. The steps may generally include either the upper or lower floor (i.e., n+1). However, in another implementation, the distance between any step can be varied to achieve an uneven distribution if desired. In other words, the height between the steps 102 can vary from step to step. Similarly the height between each step 102, the height between the flooring surface of the upper floor and the initial step, and the height between the final step and the flooring surface of the lower floor can be approximately the same in one implementation, and can vary in other implementations. In another embodiment, two or more adjacent steps 102 can be limited at the same distance longitudinally along the linear guides 106 from the upper end 116 of the column 101 such that the two or more adjacent steps 102 form an intermediate landing (or a landing partway between the upper and lower floors). It should be appreciated that in other embodiments, more than two segments can be implemented to form the column 101; one or more coupling elements 121 can be implemented on each segment; the number of linear guides 106 in each segment can vary and is not limited to five and seven as shown in FIGS. 2A and 2B; or a combination thereof.

The staircase 100 is configured to transition between states by an actuation system. In an embodiment, the actuation system includes two linear actuators 122,123. The column 101 includes the two linear actuators 122,123 positioned within the interior area 131. The linear actuator 122 is for moving the lifting platform 107 longitudinally along the column 101 (or for moving (e.g., lifting or lowering) the lifting platform 107 up and down). The linear actuator 122 extends longitudinally toward the upper and lower end 116,117 of the column 101. The linear actuator 122 includes the traveling member 124 that can move longitudinally (or toward the upper and lower ends 116,117) within the interior area 131. In the embodiment shown, the traveling member 124 is a ball nut and is coupled to a ball screw 125 of the linear actuator 122. The ball nut 124 utilizes recirculating ball bearings that rotate around the ball screw 125 to enable the ball nut 124 to move (or travel) along the ball screw 125. The linear actuator 122 includes a mount 133 that couples to the upper housing 110, as well as a mount 126 that extends through the lower housing 111 to a motor (not shown in FIGS. 2A and 2B) that supplies rotary motion to drive the ball screw 125 and move the ball nut 124.

The linear actuator 123 is for moving the landing barrier 103 (not shown in FIGS. 2A and 2B) longitudinally along the column 101 (or for moving (e.g., lifting or lowering) the landing barrier 103 up and down). The linear actuator 123 extends longitudinally from the upper end 116 toward the lower end 117 of the column 101 (e.g., toward a middle location 135 along the height of the column). The linear actuator 123 should move the landing barrier 103 at least a sufficient distance to form an effective barrier or railing above the upper floor. Further, the linear actuator 123 can extend various distances toward the lower end 117 of the column 101 in different embodiment to move the landing barrier 103 different distances below the upper floor. For example, in one implementation, the linear actuator 123 extends from the upper end 116 to the middle location 135 on the column 101 so that the landing barrier 103 is positioned between the upper floor and the middle location 135 of the column in the closed state. In another implementation, the linear actuator 123 can extend from the upper end 116 to the lower end 117 so that the landing barrier 103 can be positioned at the lower end 117 of the column 101 on the lower floor in the closed state. The linear actuator 123 includes a traveling member 127 that can move longitudinally along the column 101 and within the interior area 131 (or toward the upper and lower ends 116,117) so as to move the landing barrier 103 longitudinally along the column 101. In FIG. 2A, the traveling member 127 is shown coupled to an adaptor bracket (e.g., the adaptor bracket 1103 described in FIG. 11) that couples to the landing barrier 103. In the embodiment shown, the traveling member 127 is a ball nut and is coupled to a ball screw 128 of the linear actuator 123. The ball nut 127 utilizes recirculating ball bearings that rotate around the ball screw 128 to enable the ball nut 127 to move along the ball screw 128. The linear actuator 123 also includes a motor 129 (e.g., a stepper motor or other suitable motor) to drive the ball screw 128 to move the ball nut 127. The linear actuator 123 can include other components, such as a brake to serve as a safety feature to prevent the landing barrier 103 from falling during loss of power for instance. The linear actuator 123 includes a mount 134 that couples to the upper housing 110. In the embodiment shown, the linear actuator 122 is positioned more centrally located within the column 101 than the linear actuator 123. The term "linear actuator" is used broadly herein to refer generally to any mechanism that can move an object linearly. It should be appreciated that in other embodiments, the linear actuators can utilize a different mechanism than the ball nut and ball screw to move the traveling member longitudinally within the interior area. For example, the linear actuators can include a lead screw and lead nut, belt and pulley drive, chain drive, a direct drive, hydraulic drive, rack and pinion drive, or other suitable drive, that can move a traveling member, such as a carriage for instance. Furthermore, it should be appreciated that different types of motors can be implemented in various embodiments, such as stepper motors, servo motors, DC motor, hydraulic motor or any other suitable motor.

The lifting platform 107 is coupled to the traveling member 124 of the linear actuator 122. The lifting platform 107 is configured to be positioned in the interior area 131 of the column 101 and extend outside of the column 101. The lifting platform 107 is further configured to be positioned below the plurality of steps 102 (not shown in FIGS. 2A and 2B) when the plurality of steps 102 are coupled to the column 101. The linear actuator 122 can be used to move (e.g., lift and lower) the lifting platform 107 longitudinally along the column 101 to contact and move (e.g., lift and lower) the plurality of steps 102 longitudinally along the plurality of linear guides 106 so as to move the plurality of steps 102 longitudinally along the column 101.

The column 101 also includes upper and lower housings 110,111 that support and stabilize the column 101 and also house portions of the linear actuators 122,123. The upper and lower housings 110,111 are positioned in the interior area 131 of the column 101 at the respective upper and lower ends 116,117 of the column 101. The upper and lower housings 110,111 are configured to couple to the linear guides 106 from the interior area 131. The column 101 also includes the cover plate 108 (not shown in FIGS. 2A and 2B; shown in FIGS. 1A and 1B) that couples to the upper housing 110 to provide a cover for the upper end 116 of the column 101. The cover plate 108 can be configured to be positioned coplanar with the tread surfaces 802 of the steps 102 when in the closed state. The column 101 also includes the base plate 109 (not shown in FIG. 2A; shown in FIGS. 1A, 1, and 2B) that couples to the lower housing 111 to allow the column 101 to be securely mounted to the base housing 105 and the lower floor.

Figure 3:
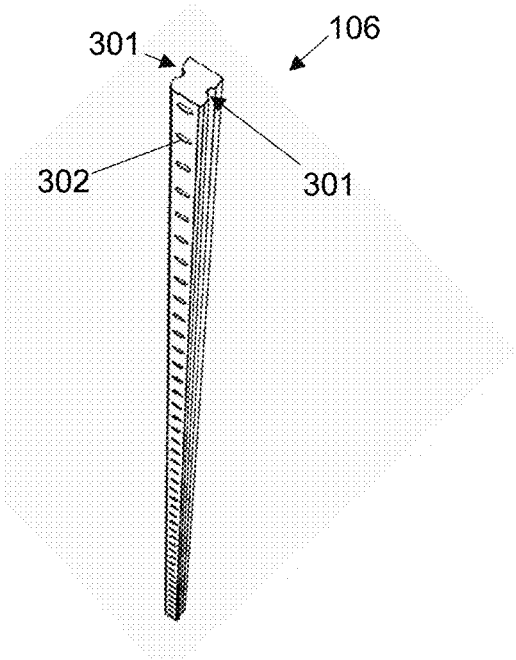
FIG. 3 illustrates a perspective view of the linear guide 106 of FIGS. 1A and 1, according to an embodiment.

The staircase 100 can be assembled in various manners. An exemplary process to assemble the staircase 100 is provided below along with additional details about the staircase 100 and components thereof. It should be appreciated that the staircase 100 can be assembled in a variety of suitable manners and sequences and that the described method is exemplary and non-limiting. To start, the linear guides 106 can be coupled together to form the core structure of the column 101. FIG. 3 illustrates a perspective view of the linear guide 106 of FIGS. 1A and 1B, according to an embodiment. In FIG. 3, the linear guide 106 is shown as an elongated member having grooves 301 and holes (of which hole 302 is a representative hole). The grooves 301 extend longitudinally along opposite sides of the elongated member to provide a shape that enables the plurality of steps 102 and the landing barrier 103 to couple to the linear guides 106 and move longitudinally along the linear guides 106. The holes 302 are also positioned down opposite sides of the linear guide 106 (only one side shown in FIG. 3) that correspond to the interior area 131 (or inside) of the column and the exterior side (or outside) of the column 101. The linear guides 106 can be made from one or more suitable materials, such as metals or metal alloys, with sufficient strength to meet the safety standards for the staircase. Example materials may include, but are not limited to, steel and aluminum.

Figure 4:
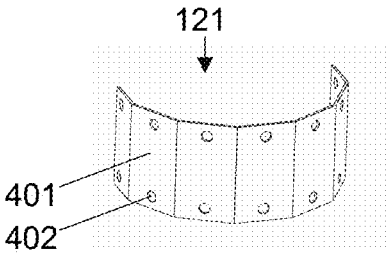
FIG. 4 illustrates a perspective view of the coupling element 121 of FIGS. 2A and 2B, according to an embodiment.
Figure 5:
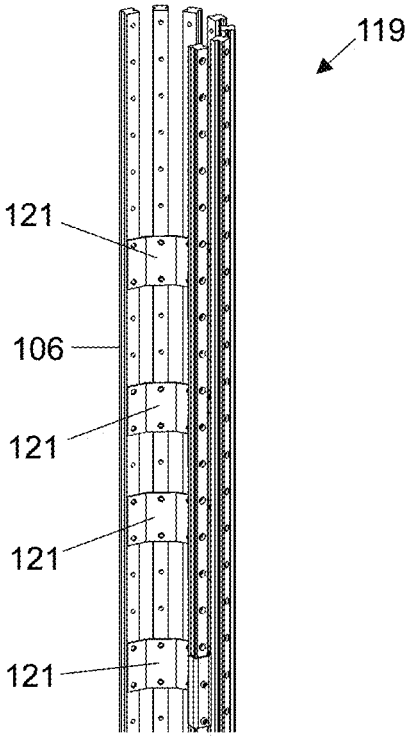
FIG. 5 illustrates a perspective view of the segment 119 of the column 101 of FIGS. 2A and 2B with coupling elements 121, according to an embodiment.

The coupling elements 121 can be coupled to multiple linear guides 106 to secure them together within the segment. FIG. 4 illustrates a perspective view of the coupling element 121 of FIGS. 2A and 2B, according to an embodiment. In FIG. 4, the coupling element 121 is shown as a bent plate having multiple sections (of which section 401 is a representative section), with each section 401 having one or more holes (of which hole 402 is a representative hole) therein. The coupling element 121 shown is bent into seven sections 401 that are configured to align with and abut the seven linear guides 106 in the segment 119. The holes 402 of the coupling element 121 are positioned to align with the holes 302 on the linear guides 106 on the side of the interior area 131. The coupling element 121 and the linear guides 106 can be coupled together, such as with bolts, screws, or other fasteners to form the segment 119. Similarly, the coupling elements 121 of the segment 118 is bent into five sections 401 having holes 402 to couple together the five linear guides 106 to form the segment 118. FIG. 5 illustrates a perspective view of a portion of the segment 119 of the column 101 of FIGS. 2A and 2B with coupling elements 121, according to an embodiment. The segment 119 is shown including the linear guides 106 coupled together by the coupling element 121 at various positions along the segment 119. The portion of the segment 119 shown includes four coupling elements 121. It should be appreciated that additional coupling elements 121 may also be included on unshown portion of the segment 119. The segment 118 of the column 101 of FIGS. 2A and 2B can be similarly configured with five linear guides 106 and the coupling elements 121. The coupling elements 121 can be made from one or more suitable materials, such as metals or metal alloys, with sufficient strength to meet the safety standards for the staircase. Example materials may include, but are not limited to, steel and aluminum. The coupling elements could also be formed by various fabrication methods, including, but not limited to, bending, machining, casting, or additive manufacturing.

The linear actuators 122,123 are to be positioned between the two segments 118,119 so as to be positioned within the interior area 131 when the column 101 is assembled. The linear actuator 122 is positioned such that the motor can be coupled to the linear actuator 122 at the lower end 117 of the column 101. The linear actuator 123 is positioned so that the end of the linear actuator 123 coupling to the motor 129 is toward the lower end 117 of the column 101 and positioned within the interior area 131 of the column 101. The linear actuators 122,123 can be coupled to the upper housing 111 before the upper housing 111 is coupled to the linear guides 106 to facilitate assembly of the staircase 100.

Figure 6A:
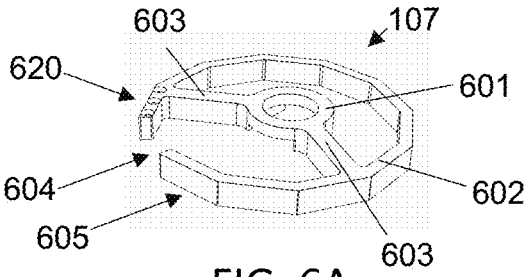
FIGS. 6A and 6B illustrate perspective views of respective top and bottom of the lifting platform of FIGS. 1A and 1B, according to an embodiment.
Figure 6B:
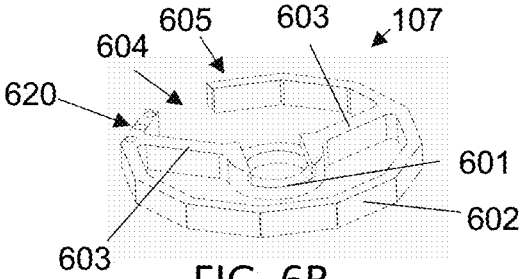

The lifting platform 107 can be coupled to the traveling member 124 of the linear actuator 122 and then positioned so that part of the lifting platform 107 will be outside of the column 101 when the column 101 is assembled. FIGS. 6A and 6B illustrate perspective views of respective top and bottom of the lifting platform of FIGS. 1A and 1, according to an embodiment. In FIGS. 6A and 6B, the lifting platform 107 is shown including a coupling portion 601 for coupling to the actuation system, a contacting portion 602 for contacting and moving the plurality of steps longitudinally along the plurality of linear guides, and spokes 603 extending from the coupling portion 601 to the contacting portion 602. The coupling portion 601 is configured to be positioned within the interior area 131 of the column 101 and couple to the traveling member 124 of the linear actuator 122. The traveling member 124 is configured to move longitudinally within the interior area 114 of the column 101 so as to move the lifting platform 107 longitudinally along the column 101. The coupling portion 601 is shaped and sized to mate with and secure to the traveling member 124 (e.g., ball nut). The contacting portion 602 is configured to be positioned outside of the column 101 and below the steps 102. In this way, the contacting portion 602 can contact and move the steps 102 longitudinally along the linear guides 106 when the lifting platform 107 is moved by the linear actuator 122. In the embodiment shown, the coupling portion 601 can be coupled to the final step 102 to guide the lifting platform 107 and prevent rubbing on either side and to reduce the side loads and buckling loads of the ball screw. Holes 620 are shown on the contacting portion 602 of the lifting platform 107 and can be used to screw, bolt, or otherwise fasten the lifting platform 107 to the final step 102 (e.g., to a gusset or a frame of the step).

The spokes 603 extend from the coupling portion 601 to the contacting portion 602. The spokes 603 are configured to extend through the respective gaps 132 formed between the segments 118,119. For example, since the segments 118,119 are to be coupled together by the upper and lower housings 110,111 at the upper and lower ends 116,117 of the column, and since none of the coupling elements 121 extend from one segment to the other, the gaps 132 are formed between the segments 118,119. The gaps 132 extend longitudinally along the segments 118,119 from the upper housing 110 to the lower housing 111. The spokes 603 enable the lifting platform 107 to be positioned within the interior area 131 and outside the column 101 and still move longitudinally along the column 101. The lifting platform 107 is configured to be positioned below the steps 102. In this way, the lifting platform 107 can be configured to move longitudinally along the column 101 to contact and move the steps 102 longitudinally along the plurality of linear guides 106 so as to lift and lower the steps 102 along the column 101. The spokes 603 are configured to move within the gaps 132 when the lifting platform 107 moves longitudinally along the column 101. In other embodiments, the lifting platform 107 can include one or more spokes in various positions; however, the spokes should align with any of the gaps 132 formed by adjacent segments. In the embodiment shown, for instance, the spokes 603 can be configured to be approximately 150 degrees from each other.

The contacting portion 602 of the lifting platform 107 includes a gap 604 that enables the lifting platform 107 to move longitudinally along the column 101 without being obstructed by the landing barrier 103. For example, in the embodiment shown, the lifting platform 107 is a ring-like structure where the coupling portion 601 is shaped like a circular ring and the contacting portion 602 is shaped like a regular dodecagon ring (or a 12-sided polygon ring with equally spaced vertices between sides). The twelve sides of the dodecagon ring are oriented to align with one of the linear guides 106. More specifically, the dodecagon ring has eleven sides (of which side 605 is a representative side) and a missing twelfth side functioning as the gap 604. The spokes 603 extend from the coupling portion 601 to the specific vertices in the dodecagon ring that correspond to the gaps 132 between the segments 118,119. The missing side of the dodecagon ring that functions as the gap 604 is positioned to align with the landing barrier 103 and to be near the specific linear guide 106 that couples to the landing barrier 103, enabling the lifting platform 107 and the landing barrier 103 to move past each other unobstructed. It should be appreciated that in other embodiments where a different number of linear guides 106 are implemented (e.g., 10), the shape of the lifting platform 107 can be modified accordingly to match the number of linear guides 106 implemented (e.g., a decagon ring for the 10 linear guides implemented). The lifting platform 107 can be made from one or more suitable materials, such as metals or metal alloys, with sufficient strength to meet the safety standards for the staircase. Example materials may include, but are not limited to, steel and aluminum.

Figure 7:
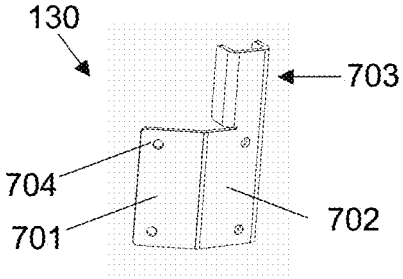
FIG. 7 illustrates a perspective view of the exemplary stop element 130, according to an embodiment.

The stop elements 130 can be coupled to the exterior side (or exterior, outside, etc.) of the column 101 (i.e., the exterior side of the linear guides 106 that is on the exterior side of the column 101). When the column 101 is assembled with the steps 102 coupled to the linear guides 106, the steps 102 are configured to move longitudinally along the linear guides 106 until limited by the stop elements 130. The stop elements 130 can be made from one or more suitable materials, such as metals or metal alloys, with sufficient strength to meet the safety standards for the staircase. Example materials may include, but are not limited to, steel and aluminum. FIG. 7 illustrates a perspective view of an exemplary stop element 130, according to an embodiment. The stop element 130 is shown as a bent plate having multiple sections (of which sections 701,702 are representative sections). The two sections 701,702 are configured to align with and abut two adjacent linear guides 106. Each of the sections 701,702 can have one or more holes (of which hole 704 is a representative hole) therein. The holes 704 of the stop element 130 are positioned to align with the holes 302 on the side of the linear guides 106 outside of the column 101. In this way, the stop elements 130 and the linear guides 106 can be coupled together, such as fastened with bolts or screws through the holes 704,302, and also can serve to help support and form the segment 119. The section 702 couples to one linear guide 106 and includes a contacting portion 703 that is positioned to contact and stop the movement of the step longitudinally along that linear rail 106. The section 701 is coupled to the adjacent linear guide with the adjacent step—i.e., the adjacent step closer to the upper floor when the steps 102 are spiraled. It should be appreciated that each of the stop elements 130 for all of the steps 102 can have different shapes from one another but should function to limit the steps 102 at the appropriate positions (or varying distances from the upper end 116). For example, one or more stops 130 can be configured without section 701 and only couple to one linear guide. Furthermore, since the holes 704 on each stop element 130 are to align with the holes 302 on the linear guides 106 for coupling, the length (or height) of each contacting portion 703 can vary as needed to ensure that the all of the steps 102 are limited at the appropriate distances along the linear guides 106 (i.e., at the appropriate locations along the column 101) to form the spiraling steps.

Figure 8:
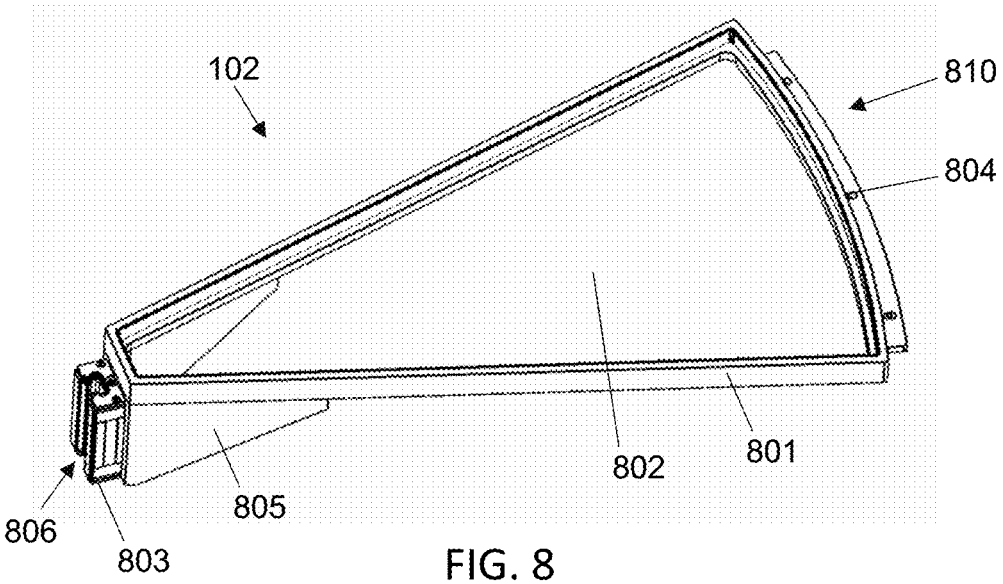
FIG. 8 illustrates a perspective view of one of the steps 102 of FIGS. 1A and 1B, according to an embodiment.

Each of the steps 102 are to be coupled to the linear guides 106 having the stop elements 130 coupled thereto. To facilitate assembly of the staircase 100, the steps 102 can be coupled to the linear rails 106 after the linear rails 106 are coupled to the upper housing 111, which has the linear actuator 122,123 coupled thereto. FIG. 8 illustrates a perspective view of one of the steps 102 of FIGS. 1A and 1B, according to an embodiment. In FIG. 8, the step 102 is shown including a frame 801, a tread surface 802 coupled to the frame 801, a coupling member 803 coupled to the frame 801, and holes 804 positioned in an outer perimeter 810 of the frame 801 with respect to the column 101. Each step 102 includes the coupling member 803 and couples to a different linear guide 106. The coupling member 803 shown is a carriage having a channel 806 shaped and sized to securely couple to and move (or slide) along the grooves 301 of the linear guide 106. During coupling, one end of the linear guide 106 can be inserted within the channel 806 to appropriately align the grooves 301 with the channel 806. The frame 801 includes a gusset 805 that provides additional support for the step 102. The gusset 805 can be configured to contact the contacting portion 703 of the stop element 130 when the step 102 is being limited by the stop element 130. The holes 804 are sized to enable the elongated members 113 to fit within, and move through, the holes 804. In an embodiment, the holes 804 are oblong to facilitate the elongated members 113 remaining fixed while the steps 102 are move up and down the column 101. The holes 804 are positioned to accommodate the desired distance between the elongated members 113, which serve as a safety wall or obstruction to prevent users from falling off of the staircase 100. The spacing (or distance) between elongated members 113, and corresponding spacing between holes 804 on the step 102, can vary in different embodiments but should be close enough to function to prevent users from falling off the staircase 100 and to meet any safety standards or regulations that may be applicable to safety railings. Example spacing between elongated members can include, but are not limited to, 10 inches or less, such as 6 inches or less. In one implementation, the elongated members 113 are positioned at 10 degree increments around the perimeter base 112 and provide less than 4 inch spacing on center (or center-to-center). The elongated members 113 can also function as hand railings that a user can hold on to while traversing the staircase 100. It should be appreciated that the number of holes 804 on each step 102 can vary in other embodiments to accommodate a different number of elongated members 113.

When the steps 102 are in the closed state, the steps are shaped and sized to fit together to form a surface that is coplanar with each other and the flooring surface of the upper floor. In the embodiment shown, eleven steps 102 are implemented in total and form a circle when positioned at the upper end 116 in the closed state. In the embodiment shown in FIGS. 1A and 1, ten of the steps 102 are shaped as 30-degree wedges with an eleventh step shaped as a 60-degree wedge to serve as a landing step (or the initial step from the upper floor). The number of steps 102, and the distance between each step 102, can vary in different embodiments depending on various factors, such as the distance between the upper and lower floors, the appropriate or desired height of each step, etc. For example, in another embodiment, twelve steps shaped as 30 degree wedges can be implemented but would require an additional linear guide. In other embodiments, the steps 102 can form a collective shape other than a circle when in the closed state, such as a decagon, hexagon, square, rectangle, ellipse, or other suitable shape. Depending on the collective shape of the steps 102, each of the steps 102 may not necessarily be the same shape. In embodiments where the steps 102 form a different collective shape, the perimeter base 112 can have a different shape (i.e., not a circle) that matches the collective shape of the steps 102.

The frame 801 and the tread surface 802 can be made of one or more suitable materials sturdy and strong enough to safely support the anticipated load (e.g., weight of people walking on the steps) and to meet any safety standards or regulations that may be applicable. Example materials for the frame 801 may include, but are not limited to, metals, metal alloys, such as aluminum, stainless steel, galvanized steel, wrought iron, etc. Example materials for the tread surfaces 802 may include, but are not limited to, metals, metal alloys, woods, and glass. In the embodiment shown, the frame 801 can be made with a metal or metal alloy while the tread surfaces 802 is made with a transparent material, such as laminated tempered glass to provide impact resistance and enable the step 102 to be see through. In this way, when all of the steps 102 are positioned at the upper end 116, the steps 102 form a substantially see-through flooring that allows people on the upper and lower floors to see into the other floor. In another embodiment, the tread surfaces 802 can be made with a non-transparent material or materials with reduced transparency. The materials of the tread surfaces 802, as well as designs included on the tread surfaces, can be selected to create different designs, patterns, message, etc. (e.g., for each step individually, or for all steps collectively when the staircase is in a closed state) and can include inlays, mosaics, lettering, words, messaging, emblems, logos, etc. In one instance, the perimeter base 112, steps 102, and the cover plate 108 are made of materials, or otherwise designed to look in a manner, that conceals the existence of the stairway 100 from the upper floor. In yet another embodiment, the tread surface 802 and the metal frame 801 can be a single unitary element made from the same material.

Figure 9:
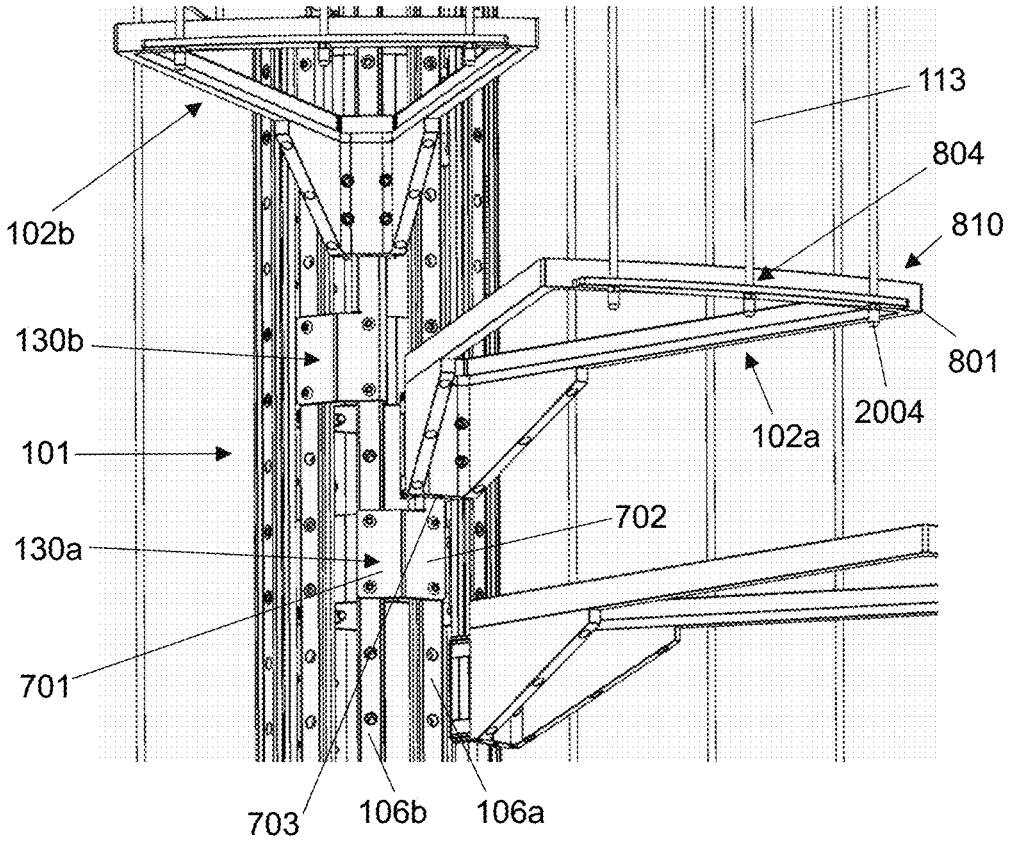
FIG. 9 illustrates a perspective view of a portion of the column 101 in FIG. 1B when the steps 102 are limited by the stop elements 130, according to an embodiment.

FIG. 9 illustrates a perspective view of a portion of the column 101 in FIG. 1B when the steps 102 are limited by the stop elements 130, according to an embodiment. In FIG. 9, two exemplary stop elements 130*a*,130*b* are shown contacting and limiting exemplary steps 102*a*,102*b*, respectively, on column 101. The stop element 130*a* is shown coupled to the column 101 and limiting the movement of a step 102*a* longitudinally along a linear guide 106*a*. The stop element 130*a* is positioned on the column 101 such that the step 102*a* is limited at the desired distance longitudinally along the linear guide 106*a* from the upper end 116 of the column 101 toward the lower end 117 of the column 101. The step 102*a* should be limited at the appropriate distance for forming spiraling steps around the column 101 between the upper floor and the lower floor. The stop element 130*a* includes sections 702,701, which are coupled to (e.g., bolted or screwed to) linear guides 106*a*,106*b*, respectively. The contacting portion 703 of the section 702 is positioned along the linear guide 106*a* so as to contact the step 102*a* and limit its longitudinal movement at the appropriate position along the linear guide 106*a* toward the lower end 117 of the column 101, as shown in FIG. 9. Similarly, the stop element 130*b* is shown coupled to the column 101 and limiting the movement of the step 102*b* longitudinally along the linear guide 106*b*. The section 701 of the stop element 130*a* is coupled to the linear guide 106*b* and does not obstruct the movement of step 102*b* because the step 102*b* is limited above (or higher than) the stop element 130*a* by the stop element 130*b*.

The linear guide 106 coupled to the landing barrier 103 is positioned next to one of the gaps 132 formed between the segments 118,119. In this way, the traveling member 127 can extend through the gap 132 to couple to the landing barrier 103 (i.e., to the coupling member 1003), and to move longitudinally within the gap 132 without being obstructed. In such case, the traveling member 127 is moving longitudinally along the column 101 and: within the interior area 131 of the column, within the gap 132, and partially outside of the column 101. Furthermore, the linear guide 106 coupled to the landing barrier 103 is configured to be positioned such that the landing barrier 103 is within the gap 604 of the lifting platform 107. In this way, sufficient space can be provided for the coupling member (e.g., the coupling member 1003 of FIGS. 10 and 11) of the landing barrier 103 to move longitudinally along the column 101 without being obstructed. The linear guide 106 coupled to the initial spiraled step 102 from the upper floor can be positioned next to (clockwise or counter clockwise depending on the direction of the steps) the linear guide 106 coupled to the landing barrier 103, with each successive linear guide 106 in the same direction coupled to each successive spiraled step 102 down the staircase 100. For the stop element 130 for the initial spiraled step 102 from the upper floor, the section 702 of the stop element 130 should be shaped and sized so that it does not prevent movement of the landing barrier along its corresponding linear guide 106. In some instances, if necessary to enable complete and unobstructed movement of the landing barrier 103, the stop element 130 for the initial spiraled step from the upper floor can couple to only one linear guide 106 and not include the section 701. Also shown in FIG. 9 is the elongated member 113 extending through the hole 804 in the step 102*a*. A stop element (e.g., the stop element 2004 of FIG. 20A) is shown coupled to the distal end of the elongated member 113 (or the end of the elongated member 113 that is distal to the perimeter base 112). The stop element abuts the outer perimeter 810 of the frame 801 to provide support to the step.

Figure 10:
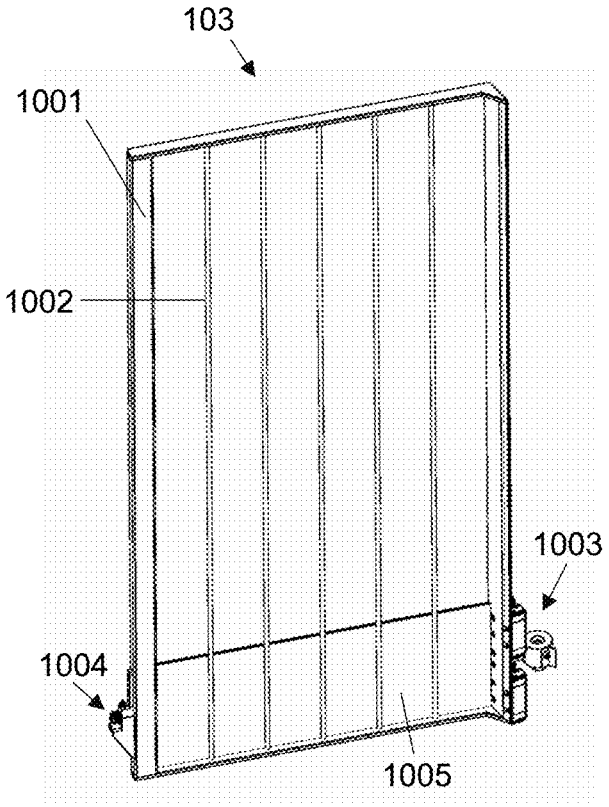
FIG. 10 illustrates a perspective view of the landing barrier 103 of FIGS. 1A and 1, according to an embodiment.

The landing barrier 103 is to be coupled to the linear guide 106 without a step 102. The linear guide 106 with the landing barrier 103 is positioned between to the linear guides 106 coupled to the initial spiraled step and the final spiraled step. To facilitate assembly of the staircase 100, the landing barrier 103 can be coupled to the linear rail 106 after the linear rails 106 are coupled to the housing. The landing barrier 103 is positioned above, and coupled to, the traveling member 127 of the linear actuator 123. FIG. 10 illustrates a perspective view of the landing barrier 103 of FIGS. 1A and 1, according to an embodiment. In FIG. 10, the landing barrier 103 is shown including a frame 1001 around the perimeter of the landing barrier 103, multiple elongated members (of which elongated member 1002 is a representative elongated member) extending across the landing barrier 103, a coupling member 1003 coupled to the frame 1001, a latch triggering member 1004 coupled to the frame 1001, and a plate 1005 coupled to the lower end (or end closest to the lower end 117 of the column 101) of the landing barrier 103. The frame 1001 and the elongated members 1002 can be made from one or more suitable materials that is sufficiently sturdy and strong enough to resist the lateral force from someone falling against it and to meet any safety standards or regulations that may be applicable. Example materials may include, but are not limited to, metals, metal alloys, woods, glass, polymeric materials, or combination thereof. In an embodiment, the frame 1001 and the elongated members 1002 are made from aluminum, stainless steel, galvanized steel, or wrought iron. In other embodiments, the landing barrier 103 can be generally solid and not include the elongated members 1002. The plate 1005 can be optionally included to both sides of the landing barrier 103 to increase stiffness and support to the landing barrier 103. The plate 1005 can made from one or more suitable materials, such as metals, metal alloys, woods, glass, polymeric material, or combination thereof. In an embodiment, for example, the plate 1005 can be a flat metal sheet, such as a sheet of stainless steel.

Figure 11:
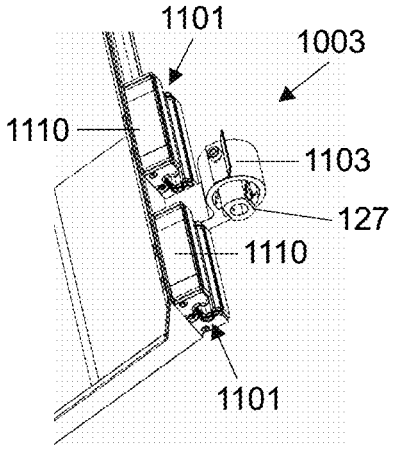
FIG. 11 illustrates a close-up perspective view of the coupling member 1003 shown in FIG. 10, according to an embodiment.

FIG. 11 illustrates a close-up perspective view of the coupling member 1003 shown in FIG. 10, according to an embodiment. In FIG. 11, the coupling member 1003 shown includes a body (or carriage) 1110 having a channel 1101 shaped and sized to securely couple to, and move (or slide) along, the grooves 301 of the linear guide 106 in which it is coupled. During coupling, one end of the linear guide 106 can be inserted within the channel 1102 to appropriately align the grooves 301 with the channel 1102. With the landing barrier 103 positioned outside of the column 101, an adaptor bracket 1103 on the coupling member 1003 can be coupled to (e.g., bolted to, screwed to, etc.) the traveling member 127 (also shown in FIG. 11 for clarity)(e.g., the ball nut) of the linear actuator 123. The linear guide 106 coupled to the landing barrier 103 is positioned next to one of the gaps 132 formed between the segments 118,119. In this way, the adaptor bracket 1103 can extend through one of the gaps 132 formed between the segments 118,119 in order to couple to the landing barrier 103 (e.g., the frame 1001) and to move longitudinally within the gap 132. The linear guide 106 coupled to the landing barrier 103 is also positioned near the gap 604 in the lifting platform 107. In this way, the adaptor bracket 1103 can move longitudinally 132 along the column 101 and pass through the gap 132 without being obstructed by the lifting platform 107. The coupling member 1003 is shown including two carriages to provide additional support to increase resistance to side loads.

Figure 12:
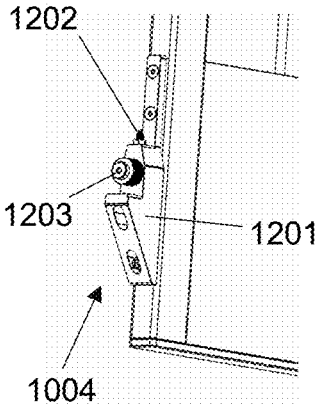
FIG. 12 illustrates a close-up perspective view of the latch triggering member 1004 shown in FIG. 10, according to an embodiment.

FIG. 12 illustrates a close-up perspective view of the latch triggering member 1004 shown in FIG. 10, according to an embodiment. In FIG. 12, the latch triggering member 1004 is shown including a body 1201, a spring plunger 1202 coupled to the body 1201, and a pulley 1203 coupled to the body 1201. When the landing barrier 103 is fully raised above the upper floor, the spring plunger 1202 is positioned so as to contact a trigger plate on the latch actuator (e.g., trigger plate 2104 and latch actuator 114 of FIGS. 21A-D) to unlatch (or retract) latching members on the latch actuator 114. When the landing barrier 103 is fully raised, the pulley 1203 is positioned so as to contact and pull a cable (e.g., cable 2109 described in FIGS. 20B, 21A-D, and 22) coupled to the multiple latches 115 positioned around the perimeter base 112. When the cable is pulled by the pulley 1203, the latches are unlatched. The unlatching of the latches 115 and the latch on the latch actuator 114 enables the steps 102 to move from the upper end 116 of the column 101 toward the lower end 117. The spring plunger 1202 and the pulley 1203 can be coupled to the body 1201 by any suitable fastening mechanism, such as bolts, screws, etc. Another contacting element, such as a protruding rod, can be used instead of the spring plunger 1202 in other embodiments. The spring plunger 1202, however, allows for leeway for positioning and timing when coordinating the pulley 1203, tension of the cable, the trigger plate 2104, and the spring plunger 1202.

Figure 13:
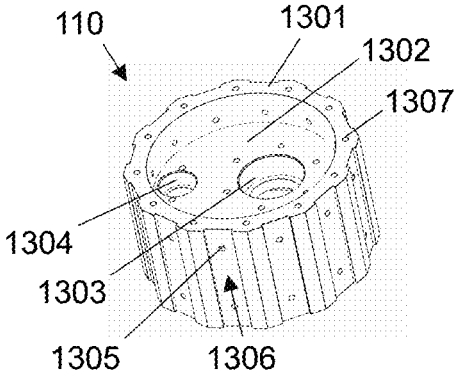
FIGS. 13 and 14 illustrate perspective views of the respective upper and lower housings 110,111 of the column 101 in FIGS. 1A and 1B, according to an embodiment.
Figure 14:
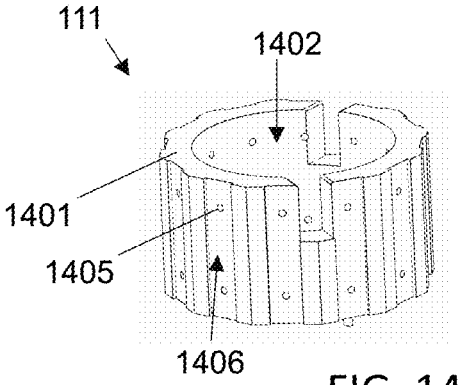

FIGS. 13 and 14 illustrate perspective views of the respective upper and lower housings 110,111 of the column 101 in FIGS. 1A and 1, according to an embodiment. In FIG. 13, the upper housing 110 is shown including an outer perimeter portion 1301 and an inner portion 1302. In FIG. 14, the lower housing 111 is shown including an outer perimeter portion 1401 and a hollow inner area 1402. In the embodiments shown, the upper and lower housings 110,111 are generally cylindrically shaped with twelve rows of holes (of which holes 1305,1405 are representative holes, respectively) positioned around the housings 110,111 to align with and secure to the linear guides 106 of the segments 118,119.

The outer perimeter portions 1301,1401 have twelve facets or flat areas (of which facets 1306,1406 are representative facets, respectively) for each of the linear guides 106 to abut. The twelve rows of holes 1305,1405 are positioned respectively within the twelve facets 1306,1406 and are configured to couple (e.g., bolt, screw, or otherwise fasten) the outer perimeter portions 1301,1401 to the inside of the linear guides 106 (or the side of the linear guides that is within the interior area 131 of the column 101) at the upper and lower ends 116,117 of the column 101, respectively. When coupled to the linear guides 106, the upper and lower housings 110,111 secure the segments 118,119 of the column 101 together and provide additional support for the column 101.

The inner portion 1302 of the upper housing 110 is configured to couple to the mounts 133,134 of the linear actuators 122,123, respectively. The inner portion 1302 includes recesses 1303,1304 that receive the mounts 133, 134, respectively. In an embodiment, the recess 1304 is offset from the center of the upper housing 110 and positioned closer to the outer perimeter portion 1301 to facilitate coupling of the linear actuator 123 with the landing barrier 103. The recess 1303 can be positioned slightly offset from the center of the upper housing 110 to position the linear actuator 122 near the center of the column 101 but offset so as to make room for the linear actuator 123 and its drive motor 129. In other implementations, the column 101 can be configured larger to provide sufficient room to center the linear actuator 122 within the column 101. The mounts 133,134 can include bearings that reside within the respective recesses 1303,1304 to enable the respective ball screws 125,128 to rotate. In one embodiment, for instance, angular contact bearings can be used to provide support for the side load as well as the axial load. To mitigate the coupling load on the ball screw, a bearing nut, retainer clip, shear pin, snap ring or similar device can be positioned on the angular contact bearing such that the ball screw (or shaft) is placed in tension instead of compression. As a result, the ball screw extends from the upper housing 110 and can take a greater load without buckling in comparison to the load being put straight down into the lower housing 111.

The mounts 133,134 can be secured to the upper housing 110 by bearing nut, retainer clip, shear pin, snap ring or similar device. The hollow inner area 1402 of the lower housing 111 enables the mount 126 to pass through the lower housing 111 and couple to a motor that is positioned below the lower floor. Furthermore, the outer perimeter portion 1301 includes holes 1307 on its top surface to couple (e.g., bolt, screw, or otherwise fasten) the cover plate 108 to the upper housing 110. In this way, the cover plate 108 covers the upper end 116 of the column 101. Similarly, the outer perimeter portion 1401 of the lower housing 111 includes similar holes (not shown in FIG. 14) on its bottom side to couple (e.g., bolt, screw, or otherwise fasten) the base plate 109 to the lower housing 111. The base plate 109 can be coupled to the base housing 105 and to the lower floor to secure the column 101. The upper and lower housings 110,111 can be made from one or more suitable materials, such as metals or metal alloys, with sufficient strength to meet the safety standards for the staircase. Example materials may include, but are not limited to, steel and aluminum.

Figure 15A:
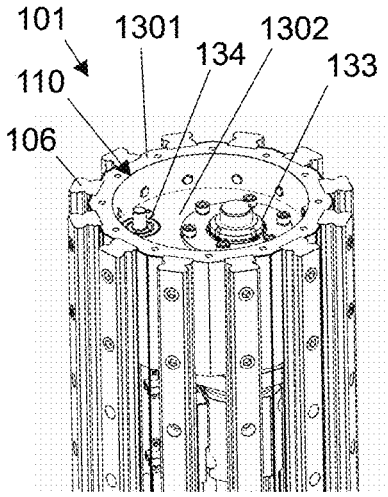
FIG. 15A illustrates a perspective view of the upper housing 110 of FIGS. 13 and 14, respectively, when coupled to the column 101, according to an embodiment.
Figure 15B:
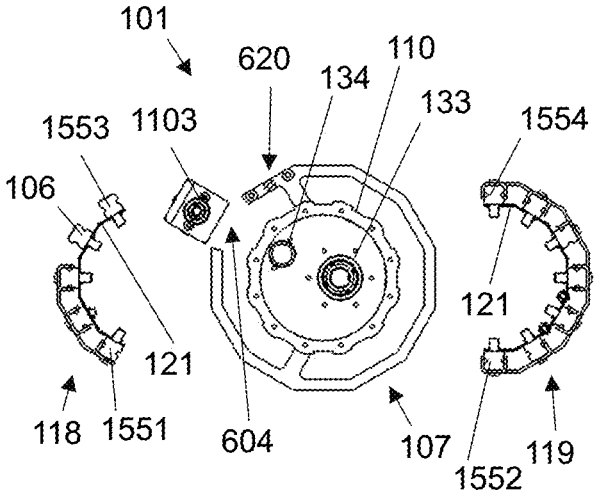
FIG. 15B illustrates a partially exploded top view of the column 101, according to an embodiment
Figure 16:
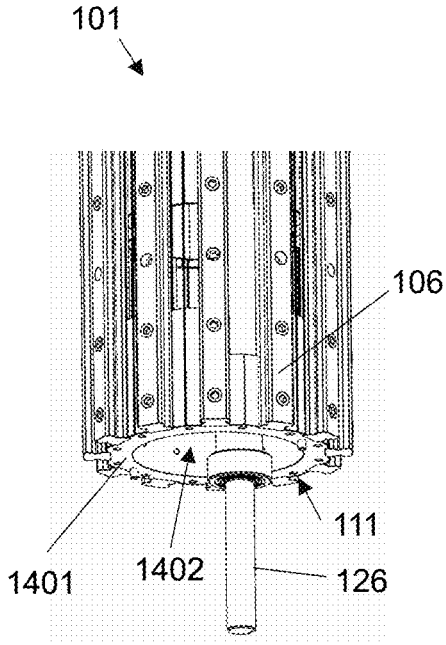
FIG. 16 illustrates a perspective view of the lower housing 111 of FIGS. 13 and 14, respectively, when coupled to the column 101, according to an embodiment.

FIG. 15A illustrates a perspective view of the upper housing 110 of FIGS. 13 and 14, respectively, when coupled to the column 101, according to an embodiment. In FIG. 15A, the upper housing 110 is shown with the outer portion 1301 coupled to the inside of the linear guides 106 of the column 101. The mounts 133,134 of the respective linear actuators 122,123 are shown coupled to the inner portion 1302 of the upper housing 110. FIG. 15B illustrates a partially exploded top view of the column 101, according to an embodiment. In FIG. 15B, the column is shown including the segments 118,119, the lifting platform 107, the upper housing 110, and the mounts 133,134 of the respective linear actuators 122,123 (e.g., the respective ball screws 125,128). The coupling elements 121 are shown coupled to the inside of the linear guides 106 of the respective segments 119,118 to secure the linear guides of each segment together. When the segments 118,119 are coupled to the upper and lower housings 110,111, gaps are formed between and along adjacent linear guides from the two segments 110,118 (or put another way, the linear guides on the end of the segments). For example, gaps are formed between and along the two adjacent linear guides 106 indicated with reference numerals 1551,1552 in FIG. 15B, and the two adjacent linear guides 106 indicated with reference numerals 1553,1554 in FIG. 15B. The spokes 603 of the lifting platform 107 are configured to extend through the gaps and move longitudinally along these gaps. The adaptor bracket 1103 on the landing barrier 103 is positioned to align with the gap 604 of the lifting platform 107. Furthermore, the traveling member 127 extends through the gap formed between the adjacent linear rails 1553,1554 to couple to the adaptor bracket 1103. For example, in the embodiment shown in FIG. 15B, the landing barrier 103 can be coupled to the linear rail 1553 to allow the adaptor bracket 1103 to align with the gap 604 and to allow the traveling member 127 to extend through the gap formed between the adjacent linear rails 1553,1554. In addition, the holes 620 on the lifting platform 107 can couple to the final step (i.e., final spiraled step). FIG. 16 illustrates a perspective view of the lower housing 111 of FIGS. 13 and 14, respectively, when coupled to the column 101, according to an embodiment. In FIG. 16, the lower housing 111 is shown with the outer portion 1401 coupled to the inside of the linear guides 106 of the column 101. The mount 126 of the linear actuator 122 is shown extending through inner area 1402 of the inner housing 111 and in position to be coupled to the motor that drives the linear actuator 122. It should be appreciated that the order of assembly of the components of the staircase 100 described herein can vary from that described for the figures. For example, the steps 102 and the landing barrier 103 can be coupled to the column 101 after the column 101 has already been assembled to include the linear guides 106, the coupling elements 121, the lifting platform 107, the hard stops 130, the linear actuators 122, 123, and the upper and lower housings 110,111 have been assembled.

Figure 17:
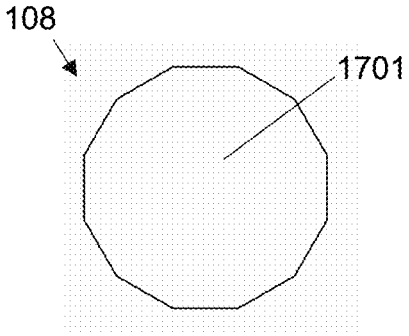
FIG. 17 illustrates a top view of the cover plate 108 of FIGS. 1A and 1B, according to an embodiment.
Figure 18:
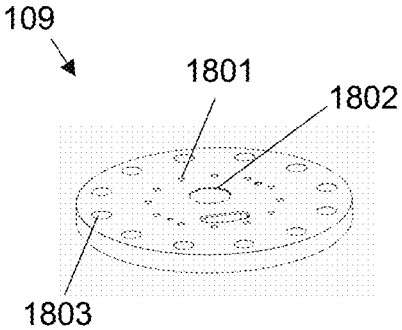
FIG. 18 illustrates a perspective view of the base plate 109 of FIGS. 1A and 1B, according to an embodiment.

The cover plate 108 can be coupled to the upper end 116 of the column 101. FIG. 17 illustrates a top view of the cover plate 108 of FIGS. 1A and 1, according to an embodiment. The cover plate 108 can be shaped and sized to cover the upper end 116 of the column 101. In the embodiment shown, the cover plate 108 has a dodecagon shape (or alternatively a circular shape) to match and cover the upper end 116 of the column 101. A top surface 1701 of the cover plate 108 is configured to be coplanar with the tread surfaces 802 of the steps 102 when the staircase is in the closed state so that the upper floor has a coplanar flooring surface. In an embodiment, the cover plate can be secured to the top of the column 101 with an adhesive. For instance, the cover plate can be glass and secured using an adhesive commonly used in the glass industry. In another embodiment, the cover plate 108 can include holes on its bottom side (not shown in FIG. 14) that are positioned to align with the holes 1307 on the upper housing 110 to couple (e.g., bolt, screw, or otherwise fasten) the cover plate 108 to the upper housing 110. The base plate 109 can be coupled to the lower end 117 of the column 101. FIG. 18 illustrates a perspective view of the base plate 109 of FIGS. 1A and 1B, according to an embodiment. The base plate 109 is shown including holes (of which hole 1801 is a representative hole) that align with the holes in the outer perimeter 1401 of the lower housing 111 so that the base plate 109 can couple (e.g., bolt, screw, or otherwise fasten) to the lower housing 111. The base plate 109 also includes a hole 1802 that is positioned and sized to allow the mount 126 of the linear actuator 122 to pass through. The base plate 109 also includes holes (of which hole 1803 is a representative hole) that are used to couple the base plate 109 to the base housing 105 and secure the column 101 to the lower floor. The cover plate 108 and the base plate 109 can be made from any variety of materials sufficient in strength to safely support a substantial load and to meet any safety standards or regulations that may be applicable. The base plate 109 is structural and serves as the main interface between the column 101 and the lower floor or base housing. The cover plate 108 is structural in the sense that is should support foot traffic and other common floor loads. Example materials for the cover plate 108 and the base plate 109 may include, but are not limited to, metals, metal alloys, woods, glass, stone, polymeric materials, or combination thereof. In some implementations, the cover plate 108 can be made from one or more materials to match the tread surfaces of the steps, surrounding flooring surface, or both. In an embodiment, the cover plate 108 and the tread surfaces are made of glass, while the base plate 109 is made of a metal or metal alloy, such as aluminum or stainless steel.

Figure 19:
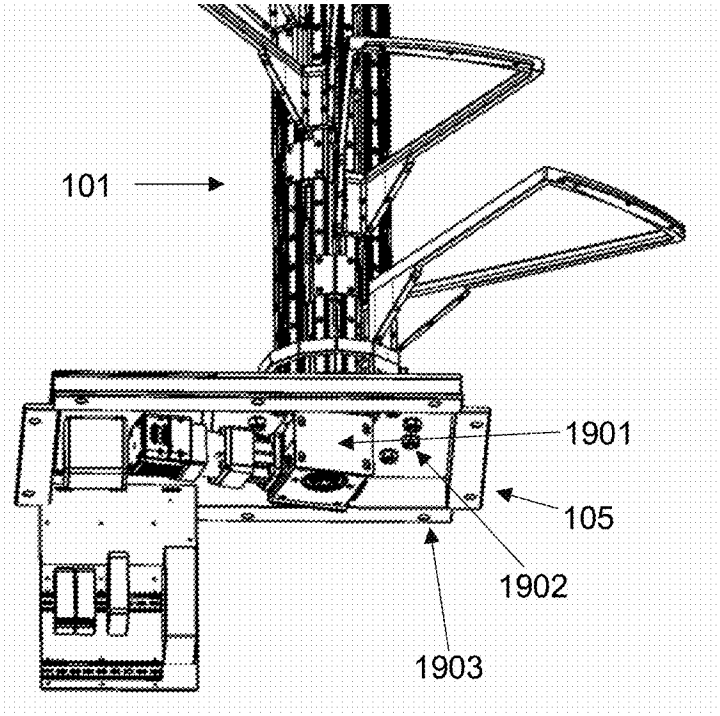
FIG. 19 illustrates a perspective view of the base housing 105 and a motor and drive system for the linear actuator 122 of FIGS. 1A and 1B when coupled to the column 101, according to an embodiment.

The base housing 105, which couples to the lower floor and houses the motor of the linear actuator 122, can be coupled to base plate 109 of the column 101, and the motor for the linear actuator 122 can be coupled to the mount 126 on the linear actuator 122. FIG. 19 illustrates a perspective view of the base housing 105 and a motor and drive system for the linear actuator 122 of FIGS. 1A and 1B when coupled to the column 101, according to an embodiment. In FIG. 19, the base housing 105 includes a body that is used to help secure the column 101 to the lower floor and to house or cover the motor and drive system 1901 of the linear actuator 122. The base housing 105 can include holes (of which hole 1902 is a representative hole and shown including a bolt therethrough) for fastening (e.g., bolting, screwing, etc.) to the lower housing 111. The base housing 105 also includes holes (of which hole 1903 is a representative hole) that are used to fasten (e.g., bolting, screwing, etc.) the base housing 105 to the lower floor. The base housing 105 can be positioned below (or within) the lower floor so as to be hidden under the flooring surface. In another implementation, the base housing 105 can be positioned to sit flush with the flooring surface. While the base housing 105 can be positioned above the flooring surface, doing so may create a tripping hazard.

The motor and drive system 1901 is coupled to the mount 126 and positioned below the base housing 105 to remain covered and out of sight. Any suitable motor and drive system 1901 can be implemented to drive the linear actuator 122 and move the traveling member 125 longitudinally within the interior area 131 of the column. Example motors can include, but are not limited to, stepper motors, servo motors, DC motors, hydraulic motors or any other type of motor. Example drive systems can include, but are not limited to, lead screw and lead nut, belt and pulley drive, chain drive, a direct drive, hydraulic drive, etc. The motor and drive system 1901 can include additional components, such as a speed reducer or enhancer (depending on the pitch of the ball screw for instance), a brake that serves as a safety feature (e.g., to prevent the steps from falling during loss of power for instance), etc. In the embodiment shown, the motor and drive system 1901 includes a servo motor that is mounted to a worm gear in a right angle gear head. The ratio of the gear drive can vary based on factors, such as the load, desired speed, motor, the pitch of the ball screw 125, etc. In one exemplary implementation of the embodiment shown, a 7.5 to 1 gear drive can be used. The right angle gear head enables power to be transmitted from the motor to the ball screw at a right angle to allow the motor and drive system 1901 to be mounted parallel to the lower floor for space saving benefits. The right angle gear head can also include other components, such as a brake to serve as a safety feature. The motor and drive system 1901 is coupled to the mount 126 on the ball screw 125 of the linear actuator 122 and can turn the ball screw 125 to move (e.g., lift and lower) the traveling member 124 longitudinally within the interior area 131 of the column 101.

Figure 20A:
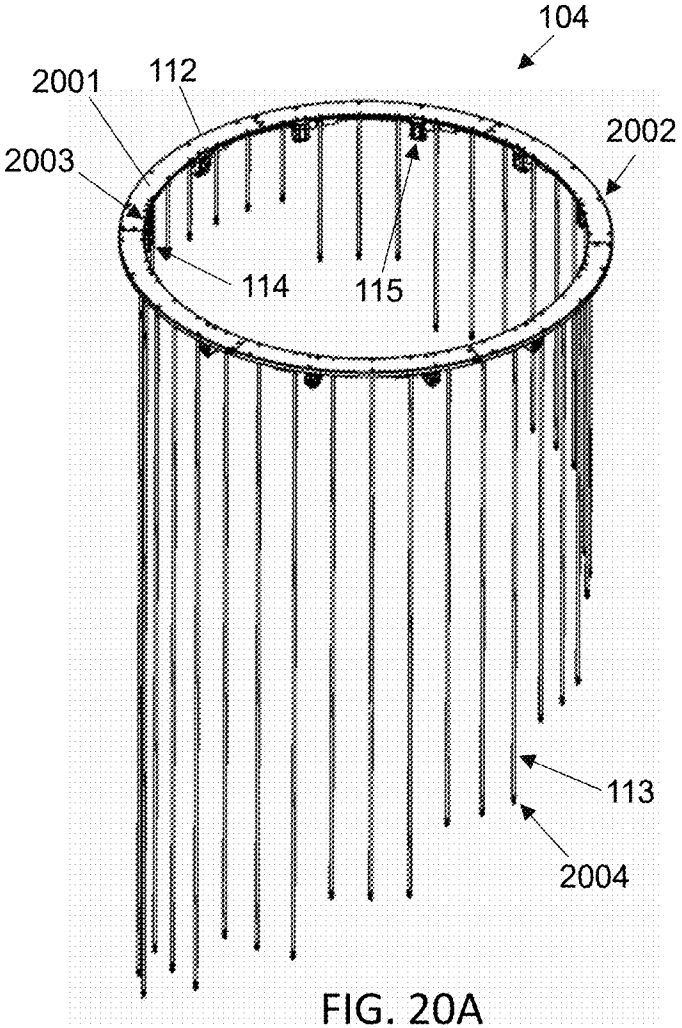
FIG. 20A illustrates a perspective view of the outer perimeter assembly 104, according to an embodiment.

FIG. 20A illustrates a perspective view of the outer perimeter assembly 104, according to an embodiment. In FIG. 20A, the outer perimeter assembly 104 is shown including the perimeter base 112, the plurality of elongated members 113 coupled to the perimeter base 112, the latch actuator 114 coupled to the perimeter base 112, and the plurality of latches 115 coupled to the perimeter base 112. The perimeter base 112 is configured to be positioned within the upper floor and extend around the outer perimeter of the steps 102 (when viewed from a top view of the staircase 100). A top surface 2001 of the perimeter base 112 is configured to be coplanar with the flooring surface of the upper floor. The elongated members 113 are coupled to the perimeter base 112 and configured to extend longitudinally the appropriate distances (or lengths) from the perimeter base 112 to the steps 102 when the staircase 100 is in the opened state. The elongated members 113 can be coupled to the outer perimeter of the steps 102 so as to form a side barrier (or safety barrier) around the outer perimeter of the spiraling steps 102 when the staircase is in the opened state. In the embodiment shown, the perimeter base 112 includes holes (of which hole 2002 is a representative hole) to couple (e.g., bolt, screw, or otherwise fasten) the perimeter base 112 within a hole in the upper floor and secure it in place. The size of the perimeter base 112 and hole in the upper floor can vary based on a variety of factors and applications, such as the desired size of the staircase, the room layout, etc. Example sizes of the perimeter base 112 can include, but are not limited to, a diameter within the range of 40 inches to 80 inches, such as 55 inches to 65 inches. In an embodiment, the diameter is approximately 60 inches. These example ranges are not intended to be limiting. Furthermore, the perimeter base 112 is shown having a shape as a circle. In other embodiment, the perimeter base 112 can include a shape other than a circle, such as a decagon, hexagon, square, rectangle, ellipse, or other suitable shape. In such embodiments, the steps 102 can have a shape that matches the shape of the steps 102.

The elongated members 113 can be coupled to the perimeter base 112 in a variety of suitable manners. For example, in one embodiment, a retaining ring groove at the proximal end of the elongated member 113 with an external retaining ring. In another embodiment, the elongated member 113 can include a head or threaded end. The perimeter base 112 can include holes 2003 that are used to couple the elongated members 113 to the perimeter base 112. For example, the elongated member 113 can include a head at its proximal end (or the end proximal to the perimeter base 112) and threading at its distal end (or the end distal to the perimeter base). Once the elongated members 113 are inserted through the holes 2003, the heads and appropriately sized retaining rings (or nut if the proximal end of the elongated member 113 is also threaded) can be used to fix or otherwise secure the proximal end of the elongated member 113 to the perimeter base 112. If the head of the elongated member 113 protrudes from the top surface 2001 of the perimeter base 112, a safety hazard may exist. Thus, in one implementation to avoid such a possible hazard, the perimeter base 112 can be configured so that its holes 2003 are set back within a slight recess, or within a lower layer of the perimeter base 112, so that the head of the elongated members 113 can be coplanar with, or sit below, the top surface 2001. In another embodiment, the elongated members 113 can be secured to anchoring components positioned beneath the perimeter base 113. The anchoring components can, for example, be secured to bottom of the perimeter base 113 and include holes (similar to the holes 2003) for securing the elongated members to the perimeter base 113. In yet another embodiment, the proximal end of the elongated members 113 can be threaded (without a head) and configured to screw into the holes 2003, which have also been threaded to mate with the elongated members 113.

To couple to the steps 102, the elongated members 113 can be inserted through the corresponding holes 804 of the frames 801 of the steps 102. Once extending through the holes 804, stop elements 2004 can be positioned at the distal end of the elongated members 113 to prevent (or stop) the elongated members 113 from being removed from the holes 804 in the steps 102. For example, the stop elements 2004 can be threaded caps, nuts, etc., that securely fasten to the distal end of the elongated members 113 but are too large to pass through the holes 804 in the frame 801 of the steps 102. The stop elements 2004 can also provide additional support for the steps 102 when abutting the steps 102 in the opened state of the staircase 100. In an embodiment, the stop elements 2004 can include double nuts that can be adjusted so that the stop elements 2004 abut the steps 102.

In another embodiment, the elongated members 113 can be extend from the perimeter base 112 but not couple to the steps 102 (e.g., extend through the holes 804 in the steps 102). For instance, the steps 102 may not extend all the way to the elongated members 113. As the steps 102 are not supported by the stop elements 2004 on the elongated members 113, the steps 102 should be strong enough to be cantilevered from the column 101. For example, the coupling member 803 can be reinforced (e.g., with two carriages, or one larger carriage) to provide additional support to the cantilevered step 102; the steps 102 can include a stronger gusset to provide additional support, etc.

In yet another embodiment, the elongated members 113 pass through the holes 804 in the steps 102, but extend completely to the lower floor and secured at the floor (rather than terminate below each step when in the open state and hang in the air on the lower floor when the closed state). The elongated members 113 can still include the stop elements 2004 at each step height, but the elongated member 113 would continue to extend down to the floor from there. The stop elements 2004 can be threaded, secured with a retaining clip, clamp, screws, etc.

In yet another embodiment, the elongated members 113 can be eliminated entirely. In such case, the steps 102 should be sufficiently strong without the support from the elongated members 113. Further, there can be some other means of fall protection at the perimeter, such as an adjacent wall, fixed railing, balusters, handrail, etc.

In yet another embodiment, the elongated members 113 can be retractable. For example, the elongated members 113 can be a telescoping poles that are coupled to the perimeter base 112 and to the steps 102. The telescoping poles extend as the steps 102 are lowered and retract as the steps 102 are raised. The length of the telescoping poles can be adjusted to allow the steps 102 to reach their opened state positions when fully extended so that they can also provide support to the steps 102. In yet another embodiment, the elongated members 113 can include retractable cables that are coupled to the perimeter base and the steps 102. For example, the cables can be configured to extend (e.g., unwind) from spools as the steps 102 are lowered and retract (e.g., wind) around spools as the steps 102 are raised. The spools can be coupled to the perimeter base 112 or to the steps 102 in different embodiments. Stop elements can also be positioned on the cables at the appropriate lengths to abut and support the steps 102 when in the opened state.

Figure 20C:
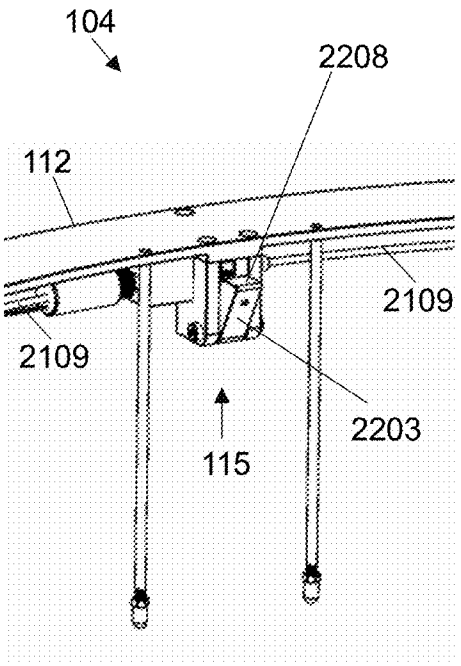
FIG. 20C illustrates a close-up perspective view of one of the latches 115 on the outer perimeter assembly 104 of FIG. 20A, according to an embodiment.
Figure 20B:
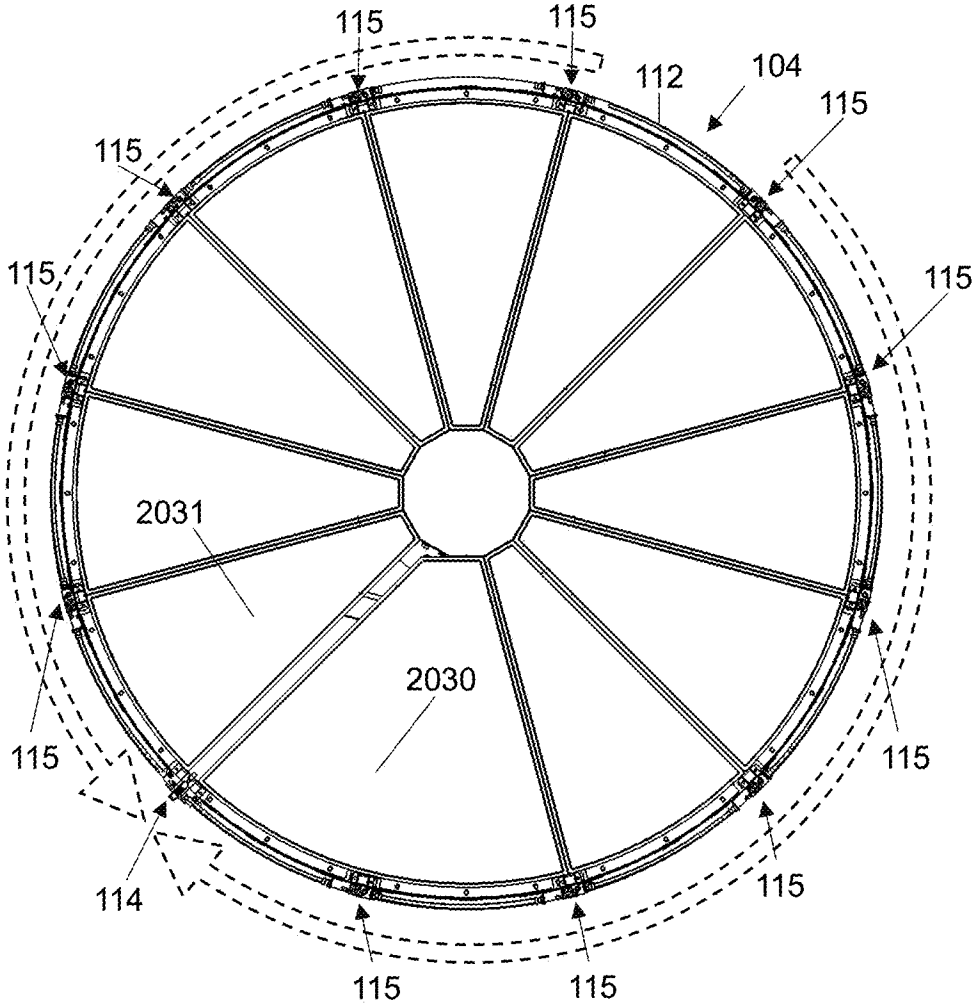
FIG. 20B illustrates a top view of the outer perimeter assembly 104 of FIG. 20A when latching the steps 102 in position in the closed state of the staircase, according to an embodiment.

FIG. 20B illustrates a top view of the outer perimeter assembly 104 of FIG. 20A when latching the steps 102 in position in the closed state of the staircase, according to an embodiment. As shown in FIG. 20B, the outer perimeter assembly 104 includes one latch actuator 114 and eleven latches 115 positioned around the perimeter base 112, such as every 30 degrees. The latch actuator 114 is positioned between the initial and final steps 102 (indicated in FIG. 20B with reference numbers 2030 and 2031, respectively), which are spaced slightly apart to permit the landing barrier to pass through. The latch actuator 114 includes two latching members (e.g., latching members 2103 described later in FIGS. 21A-D)—one latching member contacting and latching the initial step 2030 and the other contacting and latching the final step 2031. The two latching members are spaced far enough apart to enable the landing barrier 103 to pass through. The latches 115 are positioned at the remaining points between the steps 102. Each of the latches 115 includes a latching member (e.g., latching member 2203 of FIG. 22) that is wide enough to contact and latch the two steps 102 that it sits between. In the embodiment shown, the initial step 2030 has double the width (e.g., 60 degrees instead of 30 degrees) of the other steps 102, and one of the eleven latches 115 is positioned in middle of the initial step 2030. When the steps 102 are latched in the closed state position, the steps 102 cannot move down the column 101 to the open state position until the latching members of the latch actuator 114 and the latches 115 are retracted and unlatched. A cable (e.g., cable 2109 described in FIGS. 21A-D and 22) is configured to extend through the latch actuator 114 and be routed in each direction around the perimeter base 112 to couple to multiple latches on each side. For example, in the embodiment shown, the cable 2109 is routed to five latches 115 to one side of the latch actuator 114, and to six latches 115 to the other side of the latch actuator 114. The latch actuator 114 is configured to pull on the cable 2109 (in the direction shown by the dotted arrows) when triggered to switch the latches 115 from the latched state to the unlatched state, as will be described in more detail in FIGS. 21A-D, and 22.

FIG. 20C illustrates a close-up perspective view of one of the latches 115 on a portion of the outer perimeter assembly 104 of FIG. 20A, according to an embodiment. As shown in FIG. 20C, the latch 115 is shown coupled to (e.g., bolted to, screwed to, or otherwise fastened to) the outer perimeter assembly 104 and positioned below the perimeter base 112. A latching member 2203 is configured to extend out from below the perimeter base 112 when in a latched state (as shown in FIG. 20C) and to retract (or rotate) back under the perimeter base 112 to enter an unlatched state via the cable 2109. A contacting surface 2208 of the latching member 2203 contacts and supports the steps 102 when latched in the closed state. The latch actuator 114 can be similarly positioned along the perimeter base 112 to move a latching member (e.g., the latching members 2103) between latched and unlatched states. Further details regarding the latching actuator 114 and the latches 115 are provided in in FIGS. 21A-D, and 22.

Figure 21A:
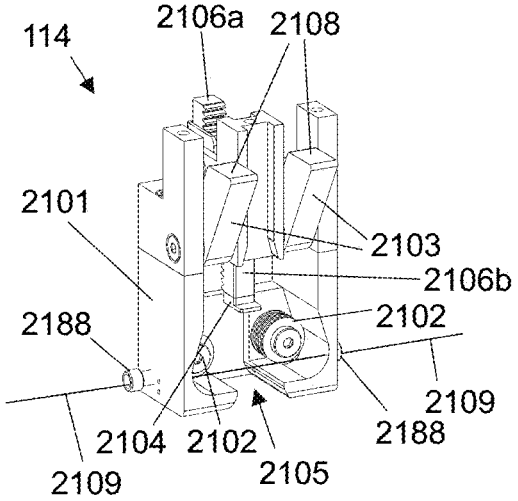
FIGS. 21A and 21B illustrate perspective and cross-sectional side views, respectively, of the latch actuator 114 in FIG. 20A when latched, according to an embodiment.
Figure 21B:
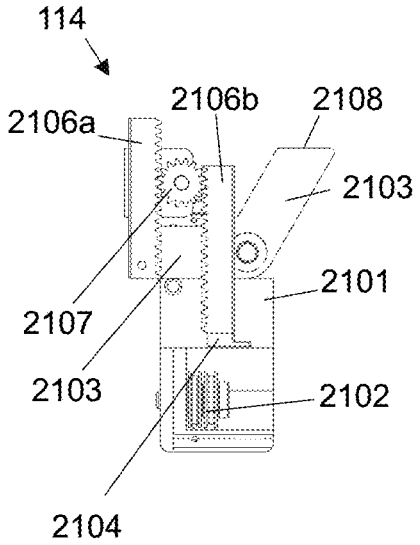
Figure 21C:
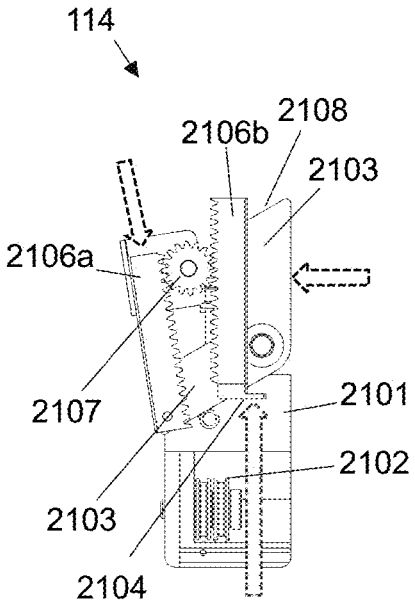
FIGS. 21C and 21D illustrate cross-sectional side view and front view, respectively, of the latch actuator 114 in FIG. 20A when unlatched, according to an embodiment.
Figure 21D:
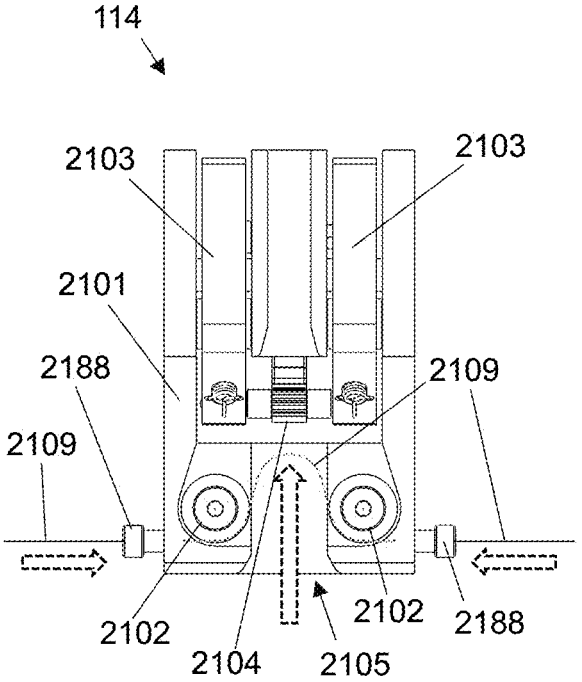

FIGS. 21A and 21B illustrate perspective and cross-sectional side views, respectively, of the latch actuator 114 in FIG. 20A when latched, according to an embodiment. FIGS. 21C and 21D illustrate cross-sectional side view and front view, respectively, of the latch actuator 114 in FIG. 20A when unlatched, according to an embodiment. In FIGS. 21A-D, the latch actuator 114 is shown including a body 2101, two pulleys 2102, latching members 2103, a trigger plate 2104, entry port 2105, cable ports 2188, two racks 2106*a*,2106*b*, a pinion 2107, and a cable 2109. The latch actuator 114 is positioned below the perimeter base 112 such that the latching members 2103 extend out from the perimeter base 112 when in the latched state and are retracted back under the perimeter base 112 when in the unlatched state. The latching members 2103 are generally V-shaped and rotatably coupled to the body 2101. One end of each latching member 2103 is coupled to the rack 2106*a* and the other end of each latching member 2103 has a contact surface 2108. The pinion 2107 is positioned between the racks 2106*a*, 2106*b*. The trigger plate 2104 is coupled to the end of the rack 2106*b* and is positioned above the entry port 2105. In FIGS. 21A and 21B, the racks 2106*a*,2106*b*, pinion 2107, and the latching members 2103 are biased in the "latched state" (or latched). When the staircase 100 is in the closed state, the latching members 2103 are in the latched state with the contact surfaces 2108 positioned below, and abutting, the initial and final steps 2030,2031 to support and further secure the initial and final steps 2030,2031 in its position in the closed state of the staircase 100. For instance, one of the contact surfaces 2108 can be positioned under the initial step 2030 and the other positioned under the final step 2031. The latch actuator 114 is positioned to align with the latch triggering member 1004 of the landing barrier 103; and more specifically, positioned so that the spring plunger 1202 and the pulley 1203 on the landing barrier 103 will enter the entry port 2105 of the latch actuator 114 when the landing barrier 103 is raised all the way up the column 101. As the landing barrier 103 is raised, the spring plunger 1202 enters the entry port 2105 and pushes the trigger plate 2104 up, which in turn moves the racks 2016 and pinion 2107 such that the latching members 2108 are unlatched (or rotated into the unlatched state), as represented by the dotted arrows in FIG. 21C. In the unlatched state, the contacting surfaces 2108 are no longer positioned below the initial and final steps 2030,2031, thereby allowing the initial and final steps 2030,2031 to move down the column. In FIGS. 21A and 21B, the cable 2109 extends through the cable ports 2188. The cable 2109 extends around the perimeter base 112 and couples to the remaining latches 115. In FIGS. 21A and 21B, the cable 2109 is shown biased in a state that maintains the latches 115 in a latched state (or latched). As the landing barrier 103 is raised, the pulley 1203 on the landing barrier 103 enters the entry port 2105 and pulls the cable 2109 up between the two pulleys 2102 on the latch actuator 114, which in turn pulls the cable 2209 on both sides of the latch actuator 114 around the perimeter base 112 to trigger the latches 115 to unlatch, as represented by the dotted arrows shown in FIG. 21D.

Figure 22:
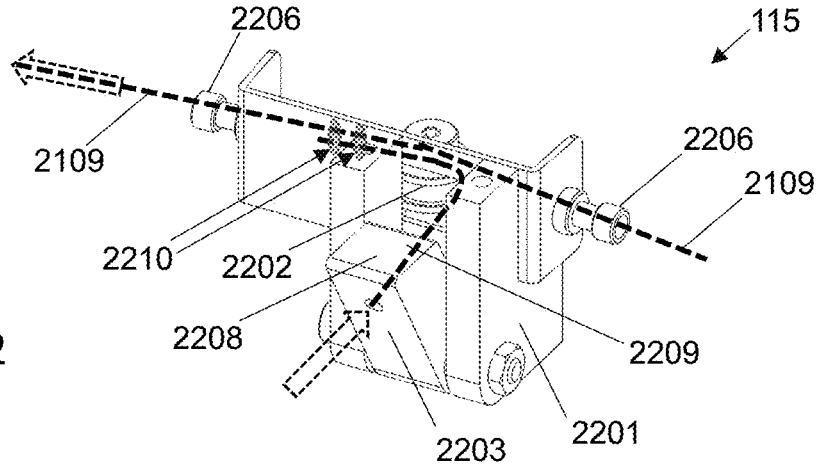
FIG. 22 illustrates a perspective view of the latch 115 of FIG. 20A when in the latched and unlatched state, respectively, according to an embodiment.

FIG. 22 illustrates a perspective view of the latch 115 of FIG. 20A when in the latched state, respectively, according to an embodiment. In FIG. 22, the latch actuator 114 is shown including a body 2201, a pulley 2202, the latching member 2203, cable ports 2206, and cables 2109,2209. Multiple latches can be positioned around the perimeter base 112 to support and further secure any of the steps 102 in their positions in the closed state of the staircase 100. The latches 115 are positioned below the perimeter base 112 such that the latches 2203 extend out from the perimeter base 112 when in the latched state and retracted back under the perimeter base 112 when in the unlatched state. The latching member 2203 includes the contact surface 2208 at one end and is rotatably coupled to the body 2101 at its other end. In FIG. 22, the latching member 2203 is biased in the "latched state" (or latched). When the staircase 100 is in the closed state, the latching member 2203 is in the latched state with the contact surface 2208 positioned below, and abutting, two adjacent steps 102 corresponding to where it is positioned. In FIG. 22, the cable 2109 extends through the cable ports 2206 and couples to the latch actuator 114 and the other latches 115. A cable splice 2210 is provided to couple the cable 2209 with the continuous cable 2109. The cable 2209 is coupled to the latching member 2203 and is configured move the latching member 2203 from the latched state to the unlatched state when pulled. In FIG. 22, the cables 2109, 2209 are shown biased in a state that maintains the latch 115 in a latched state (or latched). In the latched state, the latching member 2203 is positioned with the contacting surface 2208 extending out from the below the perimeter base 112. As the landing barrier 103 is raised, the pulley 1203 on the landing barrier 103 enters the entry port 2105 and pulls the cable 2109 (as shown in FIG. 21D), which in turn pulls the cable 2209 to unlatch the latch 115 by retracting the latching member 2203 back toward the body 2201 of the latch 115 so that the contacting surface 2208 is retracted back below the perimeter base 112, as represented by the direction of the dotted arrows. In the unlatched state, the contacting surface 2208 is no longer positioned below two adjacent steps 102 to prevent them from moving down the column 101. In an alternative embodiment, each of the latches 115 can include a separate motor that is configured to switch a latching mechanism (e.g., solenoid or mechanical coupling element) between latched and unlatched states. In such case, the cable 2109 and the pulley 1203 on the latch triggering member 1004 are not implemented. Instead, the latch actuator can include an electronic circuitry that activates the motors to the latching mechanism to switch between the latched to unlatched state. For example, the electronic circuitry can include an electrical switch that is closed by the spring plunger when it comes in contact with the latch actuator 114, which triggers (e.g., send an electrical signal to the motors) the latches 115 to unlatch. Any suitable over-the-counter electric motors and latching system can be coupled to the bottom of the perimeter base 112 and configured to latch and unlatch at times similar to when the latches 115 of FIG. 22 are latched and unlatched.

Figure 23A:
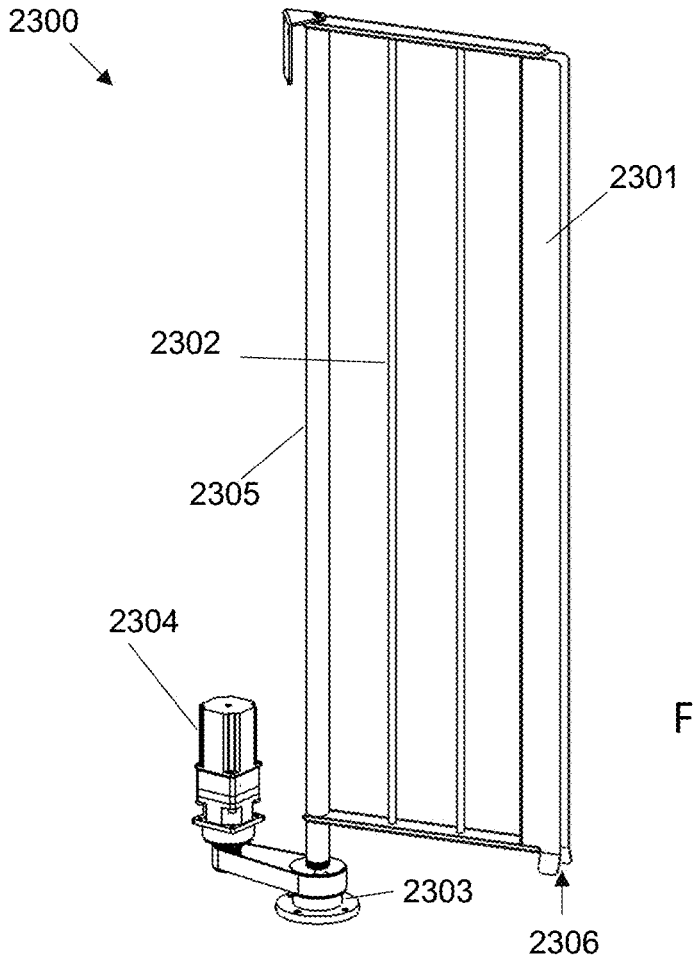
FIG. 23A illustrates a perspective view of an exemplary wall barrier, according to an embodiment.
Figure 23C:
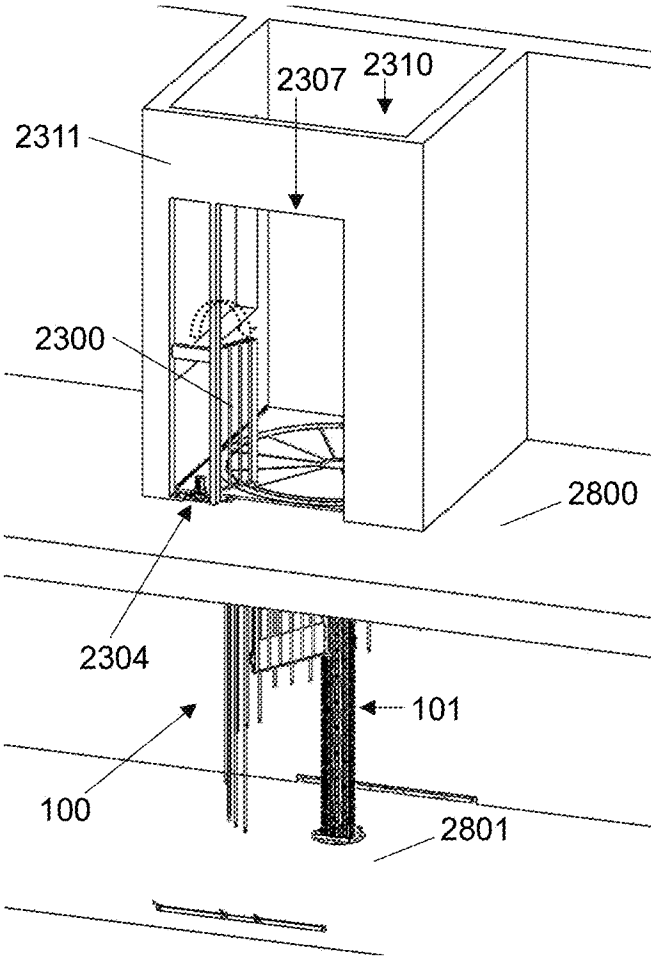
FIGS. 23B, 23C, and 23D illustrate perspective views of the staircase 100 of FIG. 1 implemented with the wall barrier of FIG. 23A positioned at various states within an enclosed room, according to an embodiment.
Figure 23B:
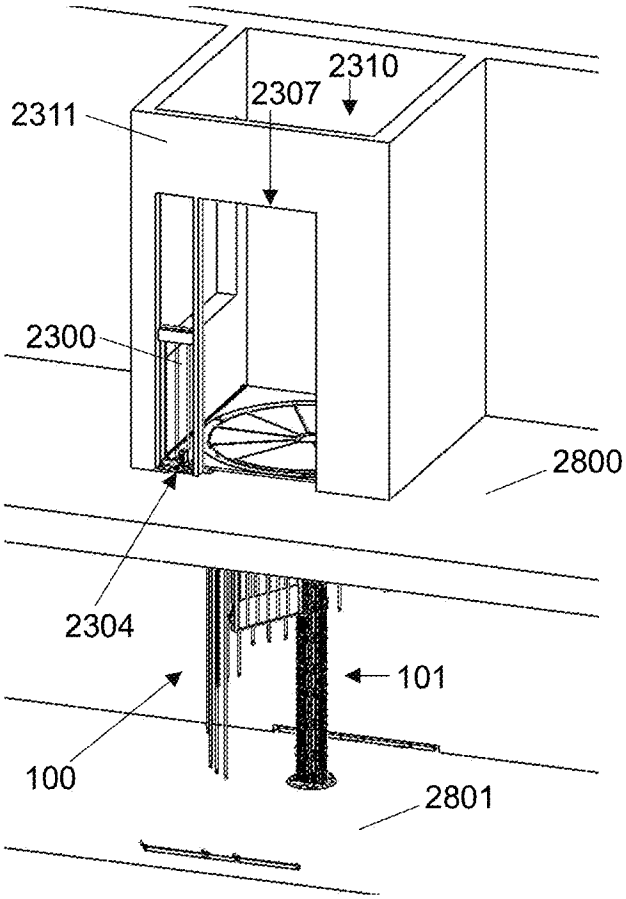
Figure 23D:
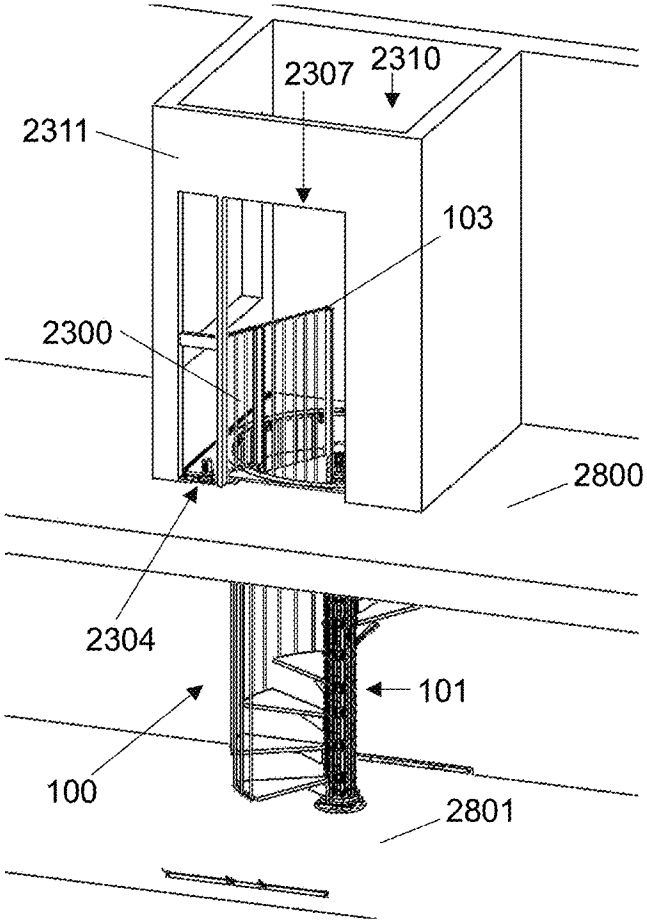

In an embodiment, the staircase 100 can include a wall barrier that is configured to serve as a safety barrier extending from the landing barrier 103 to a nearby wall. For example, the staircase 100 can be installed in a room and enclosed within four walls, including the nearby wall with the wall barrier. The four walls can be close enough to enclose the staircase 100 such that the wall barrier and four walls can work in conjunction to prevent access to the staircase from everywhere except the landing or initial step. In this way, people are prevented from walking around the landing barrier 103 and potentially falling down the staircase 100. In some applications, the lower floor may also include four walls that enclose the staircase 100 and act as a safety feature to block off the elongated members 113 and landing barrier 103 when in the closed state. FIG. 23A illustrates a perspective view of an exemplary wall barrier, according to an embodiment. FIGS. 23B, 23C, and 23D illustrate perspective views of the staircase 100 of FIG. 1 implemented with the wall barrier of FIG. 23A positioned at various states within an enclosed room, according to an embodiment. FIGS. 23A-D are described here together. For the sake of brevity and clarity, not every feature of the wall barrier of FIG. 23A is indicated with reference numbers in FIGS. 23B-D. As indicated in FIG. 23, a wall barrier 2300 is shown including a frame 2301 around the perimeter of the wall barrier 2300, a coupling channel 2306, multiple elongated members (of which elongated member 2302 is a representative elongated member) extending across the wall barrier 2300, a mount 2303 coupled to the frame 1001 and to the upper floor, and a motor 2304 coupled to the mount 2303. The mount 2303 is configured to allow the wall barrier 2300 to rotate about the mount 2303 and a side 2305 of the frame 2301. The frame 2301 and the elongated members 2302 can be made from any suitable material that is sufficiently sturdy and strong enough to resist the lateral force from someone falling against it. Example materials may include, but are not limited to, metals, metal alloys, such as aluminum, stainless steel, galvanized steel, wrought iron, tempered glass, etc.

In FIGS. 23A, 23B, and 23C, the wall barrier 2300 and the staircase 100 are shown installed within a room 2310. The room has a wall 2311 with an entry 2307 to the staircase 100. Flooring surfaces 2800,2801 are shown for the upper and lower floors, respectively. Although not shown in FIGS. 23A-C, a door can be implemented within wall 2311 to allow entry into the room 2310 and the staircase 100. In an embodiment, the motor 2304 can be positioned within the nearby wall 2311 and provide power to a belt and pulley drive system to rotate the wall barrier 2300. In another embodiment, the motor 2304 can be positioned below the upper floor close to the wall 2311 of the room 2310 and provide power to a direct drive system to rotate the wall barrier 2300. The motor 2304 is configured to rotate the frame 2301 about the mount 2303 which can pivot. In this way, the side 2305 of the frame 2301 can remain close to the wall 2311 while the frame 2301 rotates between states. The portion of the wall 2311 where the wall barrier 2300 is installed is shown see-through for clarity and to facilitate understanding. In the state shown in FIG. 23B, the frame 2301 is positioned back toward the wall 2311 (e.g., against or within the wall 2311). In the state shown in FIG. 23C, the frame 2301 is rotated to extend out from the wall 2311 (as represented by the dotted arrow) so that the coupling channel 2306 (e.g., a u-shaped channel) of the wall barrier 2300 aligns with the landing barrier 103. In this way, when the landing barrier 103 is raised up the column 101, the landing barrier 103 will enter and move within the channel 2306. The coupling channel 2306 can include a flared opening to facilitate the landing barrier 103 to enter the coupling channel 2306. In the state shown in FIG. 23C, the landing barrier 103 is raised all the way up the column 101 and coupled to the wall barrier 2300. The wall barrier 2300 prevents user from going the incorrect way around the landing barrier 103 into the staircase 100. Since the landing barrier 103 is coupled within the coupling channel 2306, the wall barrier 2300 and the landing barrier 103 form a safety barrier that ensures users enter to the proper side of the landing barrier 103.

In another embodiment, such as if the room 2310 may not include a door within the entry 2307, the wall barrier 2300 can be configured to be fixed in the position shown in FIGS. 23C and 23D. In such case, for example, the motor 2304 is not necessary and the wall barrier 2300 is fixed in place. In yet another embodiment, such as where the staircase 100 is not sufficiently enclosed within the four walls to form a safety barrier around the staircase, the perimeter base 112 can be configured to include a safety barrier around its perimeter (except for the entry 2307) to prevent users from falling through the passageway of the stairway when in the opened state. The safety barrier can include, for instance, balusters that extend from the perimeter base 112 all the way around the perimeter base 112 except for at the entry 2307, and a hand railing that is coupled to the top of the balusters. The wall barrier 2300 can optionally be included depending on the layout of the room. The landing barrier 103 can still be included and operate as previously described with or without the wall barrier 2300 implemented. In another embodiment, the landing barrier 103 can be fixed in the closed state position. In such case, the linear actuator 123 can be programmed to maintain the landing barrier 103 in the closed state position at all times and in all states. Alternatively, the linear actuator 123 can be excluded from the stairway and instead a stop element (e.g., similar to stop element 702) can be coupled to the linear guide 106 in which the landing barrier 103 is attached. The stop element can be positioned at the corresponding position to stop and support the landing barrier 103 in the closed state position. Furthermore, as the landing barrier is maintained in the closed state position, the latch actuator 114 and the latches 115 can be configured with separate motors to switch a latching mechanism (e.g., solenoid or mechanical coupling element) between latched and unlatched states. In such case, the latch triggering member 1004 and the cable 2009 are unnecessary and not implemented.

Figure 24:
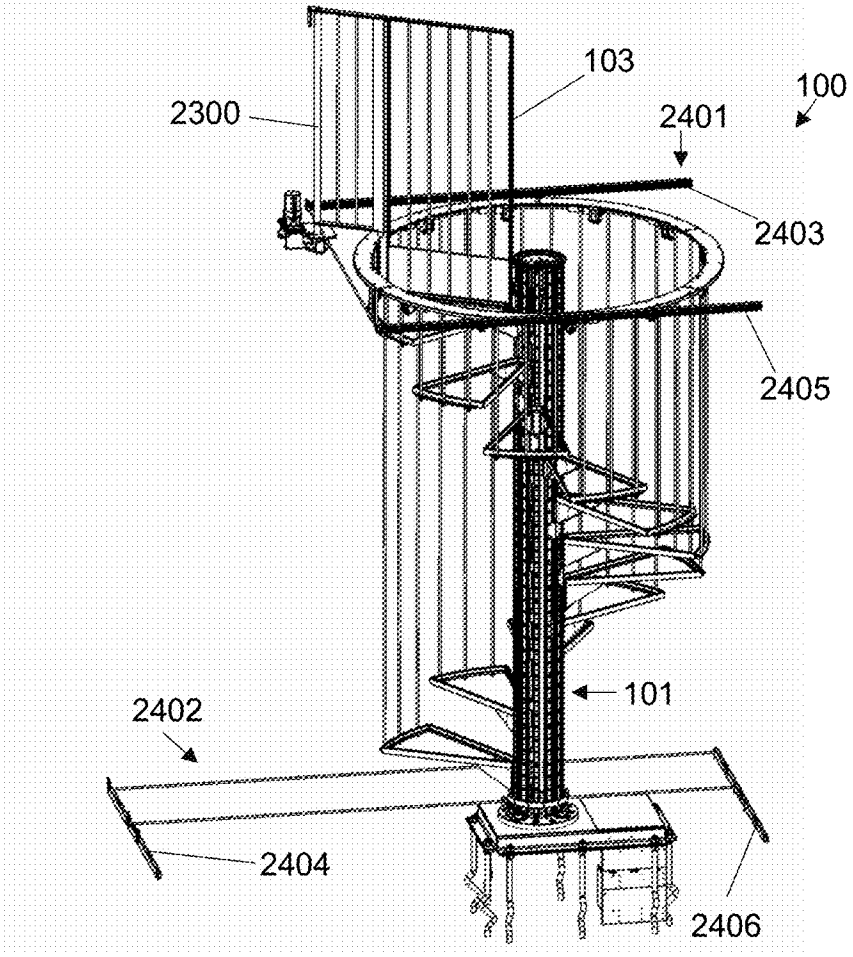
FIG. 24 illustrates a perspective view of exemplary sensor systems, according to an embodiment.

In an embodiment, a sensor system can be installed along the upper and lower floors as a safety feature to detect if someone enters the area of the staircase when the staircase is transitioning between states. Any suitable sensor system to detect when the presence of a person, animal, object, etc. can be implemented. Example sensor systems can include, but are not limited to, light sensors, motion sensors, and pressure sensors, including light curtains, safety mats, etc. FIG. 24 illustrates a perspective view of exemplary sensor systems, according to an embodiment. In FIG. 24, the staircase 100 is shown including the column 101, the landing barrier 103, and the optional wall barrier 2300. In the embodiment shown, the staircase 100 also includes upper and lower light curtains 2401,2402. The upper and lower light curtains 2401,2402 shown includes emitters 2403,2404 and receivers 2405,2406, respectively. The emitters 2403, 2404 can include, for example, an array of light emitters that are directed toward the receivers 2405,2406. The emitters 2403,2404 and receivers 2405,2406 can be positioned on the respective upper and lower floors to cover an area including the staircase 100 (e.g., the area defined by the cross section of the staircase 100) and any additional surrounding area if desired. For example, in the embodiment shown, the lower light curtain 2402 can be configured to cover a greater surrounding area than the upper light curtain 2401 since the staircase 100 is not enclosed within a room on the lower floor.

Figure 25:
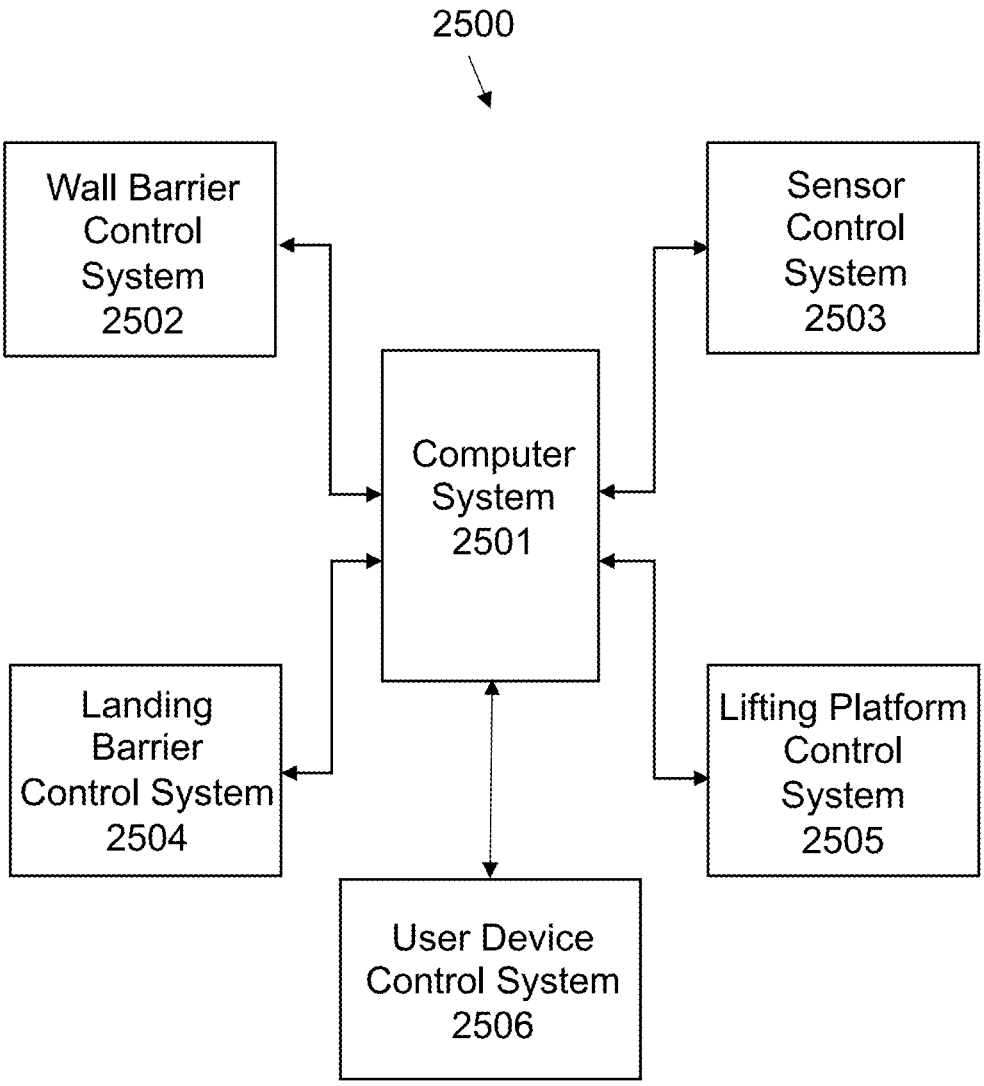
FIG. 25 illustrates a functional block diagram of an exemplary operations and control system, according to an embodiment.

FIG. 25 illustrates a functional block diagram of an exemplary operations and control system, according to an embodiment. It should be appreciated that while FIG. 25 illustrates various functional components of the operations and control system, it is not intended to represent any particular architecture or manner of interconnecting the components. It is also be appreciated that not every component of the operations and control system is shown or described for the functional block diagram, and that one or more components of the operations and control system can be combined in various implementations. In FIG. 25, an operations and control system 2500 is shown in including a computer system 2501 communicatively coupled to a wall barrier control system 2502, a sensor control system 2503, a landing barrier control system 2504, a lifting platform control system 2505, and a user device control system 2605. The computer system 2501 can be programmed to manage the wall barrier control system 2502, the sensor control system 2503, the landing barrier control system 2504, the lifting platform control system 2505, and the user device control system 2506. The computer system 2501 can include, for example, control board having a system bus coupled to a microprocessor, a Read-Only Memory (ROM), a volatile Random Access Memory (RAM), as well as other nonvolatile memory. The system bus can be adapted to interconnect these various components together and also used to communicate with the wall barrier control system 2502, the sensor control system 2503, the landing barrier control system 2504, the lifting platform control system 2506, and the user device control system 2606. Each of the wall barrier control system 2502, the sensor control system 2503, the landing barrier control system 2504, the lifting platform control system 2505, and the user device control system 2605 can include a separate controller (or other processing component) and electrical, mechanical, and optical components (e.g., memory, power electronics, I/O devices, analog and digital components, etc.) to perform the operations specific to its corresponding system. For example, the wall barrier control system 2502 can include a controller, the wall barrier 2300, the motor 2304, and various electrical components (e.g., motor driving circuitry, feedback sensors, amplifiers, power electronics, etc.) for controlling the motor 2304 and the movement of the wall barrier 2300 as programmed and described herein. The sensor control system 2503 can include a controller, the upper and lower sensors 2401,2402, and various electrical components (e.g., power electronics, etc.) for monitoring the sensor system (e.g., the upper and lower light curtains 2401,2402) and initiating responses to detected events (e.g., movement within the area of the sensors an inappropriate times) as programmed and described herein. The landing barrier control system 2504 can include a controller, the landing barrier 103, the linear actuator 123, the motor 129, and various electrical components (e.g., motor driving circuitry, feedback sensors, amplifiers, etc.) for controlling the linear actuator 123 and the movement of the landing barrier 103. The lifting platform control system 2505 can include a controller, lifting platform 107, linear actuator 122, motor and drive system 1901, and various electrical components (e.g., motor driving circuitry, feedback sensors, amplifiers, etc.) for controlling the linear actuator 122 and the movement of the lifting platform 107 and the steps 102 as programmed and described herein. The user device control system 2606 can include a user device having a controller, a display, and various electrical components to provide a user interface for the user to control the operation of the staircase 100. For example, the user device control system 2606 can include one or more touchscreen displays or other user devices (e.g., a mechanical switch, button, lever, keyboard, etc.) that enables the user to control and monitor various features and functions of the operations and control system 2500, such as activation of the staircase to move between the various states (e.g., the closed and opened states), entry of passwords or codes to operate the staircase, initiation of emergency shutdown procedures, status checks on the control systems 2502, 2503, 2504, 2505, and 2506, etc. In one implementation, more than one user device can be implemented, such as one user device on each floor to enable user control from either floor. The computer system 2501 can be programmed to receive the user commands or events (e.g., initiating a transition of the staircase 100) from the user device, and respond accordingly by communicating the appropriate control signals to one or more of the wall barrier control system 2502, the sensor control system 2503, the landing barrier control system 2504, and the lifting platform control system 2505. In an embodiment, the staircase 100 can transition automatically (e.g., automatically cascade) from the closed state to the open state, and vice versa, in response to a single user command or event initiated by the user. In some implementations, the stairway 100 can be configured to transition to some or all of the states described herein via corresponding user commands or events.

In use, the staircase 100 is configured to move between various states, including the closed state and the opened state, as desired or needed. FIGS. 26-31 illustrate the staircase 100 in various states, according to an embodiment. FIGS. 26-31 are described here together. References to one or more previously described figures (or FIGS. 1 through 25) may also be provided to facilitate understanding. For example, references to FIGS. 23B-D may be provided to illustrate the wall barrier 2300 during various states of the staircase 100. It should be appreciated that while specific features of the staircase 100 (e.g., the wall barrier 2300) may not be shown in every figure, the underlying principles of the specific features can still be applicable in varying embodiments where the feature is present. It should also be appreciated that the description of the procedure for moving the staircase 100 between states is exemplary, and that other variations of the procedure are possible without compromising the underlying principles of the present disclosure. For example, some operations can be performed sequentially or in parallel.

In FIGS. 1A and 23B, the staircase 100 is shown in a closed state. In the closed state, all of the steps 102 are at the upper end 116 of the column 101. The perimeter base 112 is securely fixed in the upper floor with the top surface 2001 coplanar with the flooring surface of the upper floor. In the closed state of the staircase 100, the perimeter base 112 is oriented around the outer perimeter of the steps 102 with the top surface 2001 coplanar with the tread surfaces 802 of the plurality of steps 102. In this way, the staircase 100 can serve as part of the flooring surface of the upper floor. The elongated members 113 (e.g., rods) are coupled to the perimeter base 112 and extend from the perimeter base 112, through the holes 804 in the outer perimeter of the steps 102, and toward the lower end 117 of the column 101. The landing barrier 103 is positioned below the upper floor with the top of the landing barrier 103 approximately flush with the top surface 2001 of the perimeter base 112, the tread surfaces 102, and the flooring surface of the upper floor. The landing barrier 103 is moved to, and maintained in, the closed state by the linear actuator 123. To position the landing barrier 103 in the closed state position, the linear actuator 123 is activated to lower the lifting platform 107 toward the lower end 117 of the column 101 until the top of the landing barrier 103 is approximately flush with the top surface of 2001 of the perimeter base 112. In an embodiment, the computer system 2501 and the landing barrier control system 2504 can be programmed to activate the linear actuator 123 to lower the landing barrier 103 to the closed state position in response to a user command or event via the user device.

Figure 26:
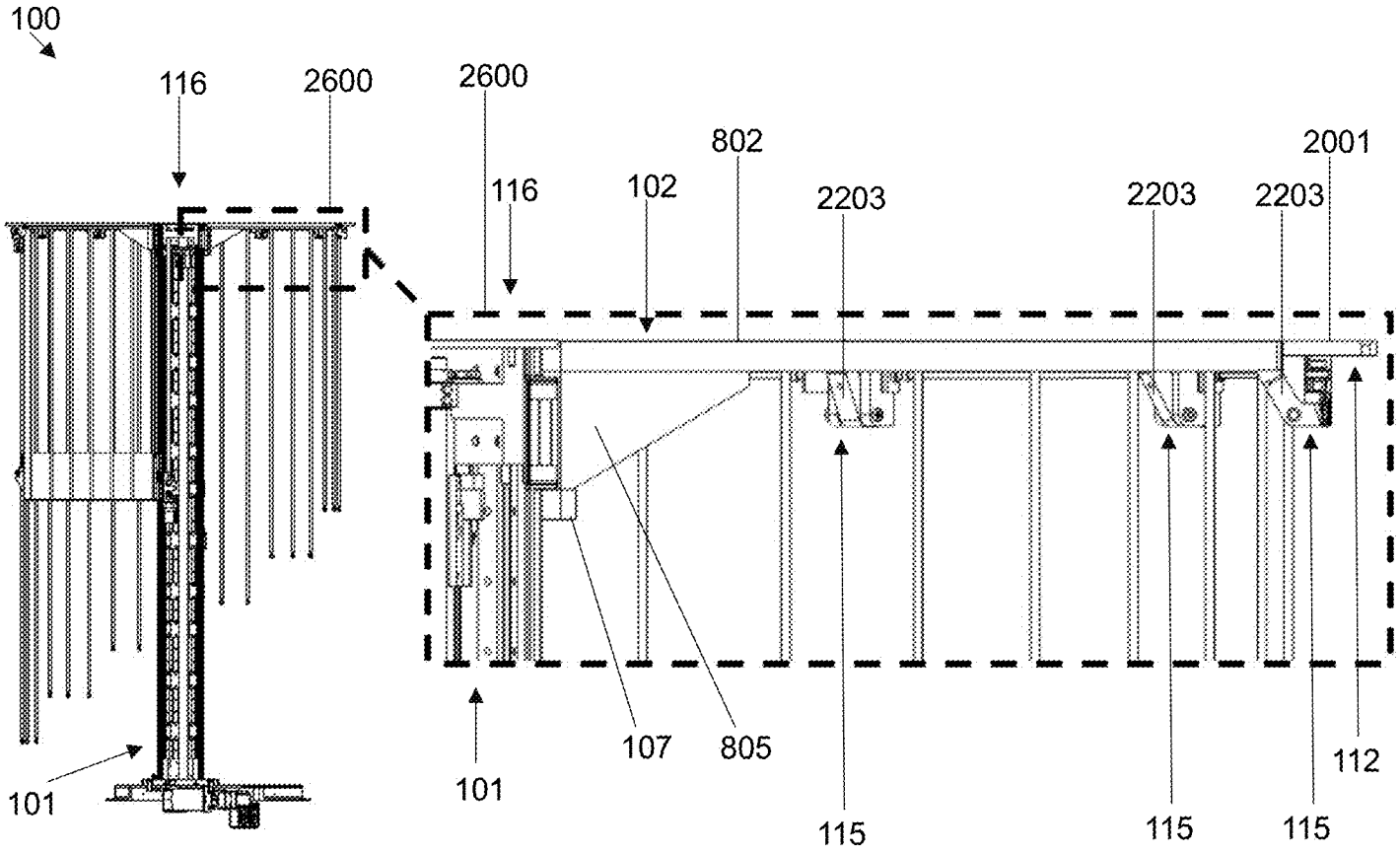
FIG. 26 illustrates a close-up portion of a front view cross section of the staircase 100 of FIG. 1A when the staircase is in the closed state, according to an embodiment.

The steps 102 are held in the closed state by the lifting platform 107, which is contacting the gusset 805 of the steps 102. To position the steps 102 in the closed state position, the linear actuator 122 is activated to raise the lifting platform 107 toward the upper end 116 of the column 101 enough for the latching members of the latch actuator 114 and the latches 115 to latch. Since all of the steps 102 are positioned above the lifting platform 107, the lifting platform 107 raises and maintains the steps 102 into the closed state position. For example, in an embodiment, the computer system 2501 and the lifting platform control system 2505 can be programmed to activate the linear actuator 122 to raise and maintain the steps 102 in the closed state position. The steps 102 are further secured in the closed state position by the latch actuator 114 and the latches 115. The steps 102 are positioned above, and contacting, the contact surfaces 2108, 2208 of the respective latching members 2103,2203. In this way, the latches securely latch the steps 102 in the closed state position and also provide support to the outer perimeter of the steps 102. FIG. 26 illustrates a close-up portion of a front view cross section of the staircase 100 of FIG. 1A when the staircase is in the closed state, according to an embodiment. In FIG. 26, a close-up portion of the cross section of the staircase 100 is shown and represented by dotted boxes 2600. As shown in the portion 2600, the steps 102 are maintained by the lifting platform 107 to a position (or height) near the upper end 116 of the column 101 where the tread surfaces 802 are coplanar with the top surface 2001 of the perimeter base 112. The steps 102 are shown latched in the closed state position by the latching members 2203, which are below and abutting the outer perimeters of the steps 102 for support. The latching member 2103 of the latch actuator 114, although not shown in portion 2600 of FIG. 26, is also positioned below and abutting the corresponding initial and final steps 102.

For embodiments where the wall barrier 2300 is implemented, the wall barrier 2300 is positioned back toward the nearby wall 2311 (e.g., flush against the wall), such as shown in FIG. 23B. For example, the wall barrier 2300 can be rotated back against or within the wall 2311. To position the wall barrier 2300 into the closed state position, the motor 2304 can be activated to rotate the wall barrier 2300 toward the wall 2311 and maintain it there during the closed state. For example, in an embodiment, the computer system 2501 and the wall barrier control system 2502 can be programmed to activate the motor 2304 to rotate the wall barrier 2300 to the closed state position.

Figure 27:
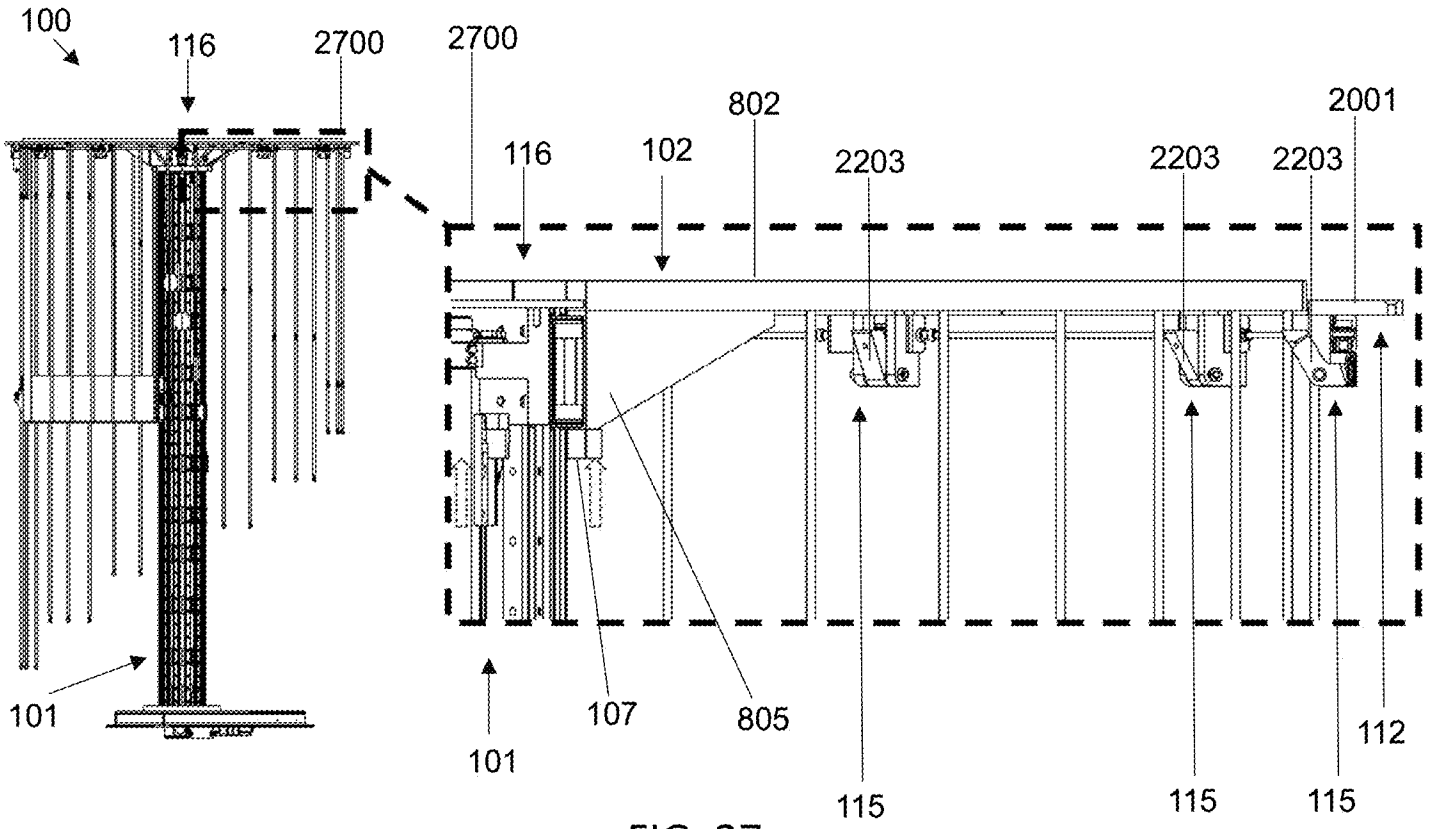
FIG. 27 illustrates a close-up portion of a front view cross section of the staircase 100 of FIG. 1A when in a state where the steps 102 are raised off of the latching members of the latch actuator and the latches, according to an embodiment.

To transition the staircase 100 to the opened state, a user can initiate the process by executing a corresponding user command or event (e.g., depressing of a button, switch, lever, etc. on a user interface or mechanical device) via the user device (e.g., touchscreen display, mechanical switch, button, lever, etc.) described for the user device control system 2506. Once the transition to the opened state is initiated by the user, the linear actuator 122 is activated to move the lifting platform 107 (via the traveling member 124) toward the upper end 116 of the column 101 so that the steps 102 are raised off of the latching members 2103,2203 of the respective latch actuator 114 and latches 115. In an embodiment, the computer system 2501 and the lifting platform control system 2505 can be programmed to activate the linear actuator 122 to raise the steps 102 off of the latching members 2103,2203 in response to the user command or event. FIG. 27 illustrates a close-up portion of a front view cross section of the staircase 100 of FIG. 1A when in a state where the steps 102 are raised off of the latching members of the latch actuator and the latches, according to an embodiment. In FIG. 27, a close-up portion of the cross section of the staircase 100 is shown and represented by dotted boxes 2700. As shown in portion 2700, the lifting platform 107 has been raised (represented by dotted arrows) by the linear actuator 122 (not shown in FIG. 27) so that the steps 102 are raised off of the latching members 2103,2203. The distance the steps 102 are raised can vary but should be large enough to create adequate space for the latching members 2203 (and 2101) to retract into the unlatched position. Example distances that the steps can be raised to clear the latches can include, but are not limited to, distances within the range of 0.125 inches to 1.5 inches, such as 0.5 inches to 1 inch, including approximately 0.75 inches in one implementation. In this state, the steps 102 are slightly higher than the flooring surface of the upper floor. As the steps 102 are raised to this state from the closed position, the elongated members 113 slide through the holes 804 of the steps 102. In an embodiment, the holes 804 are oblong so that the elongated members can stay fixed while the steps 102 move up and down.

For embodiments where the wall barrier 2300 is implemented, in response to the user command or event to transition to the opened state, the wall barrier 2300 is configured to rotate toward alignment with the landing barrier 103 and the center of the column 101, such as shown in FIG. 23C. For example, the motor 2304 can be activated to rotate the wall barrier 2300 away from the wall 2311 until it is aligned with the landing barrier 103 and then maintain it in that position while the steps 102 are raised from the closed state. In an embodiment, the computer system 2501 and the wall barrier control system 2502 can be programmed to activate the motor 2304 to rotate the wall barrier 2300 to alignment with the landing barrier 103 in response to the user command or event. The timing of when the wall barrier 2300 is rotated in alignment with the landing barrier 103 can vary in different implementations—e.g., simultaneous to, before, or after the raising of the steps 102 off of the latching members 2103,2203.

Figure 28:
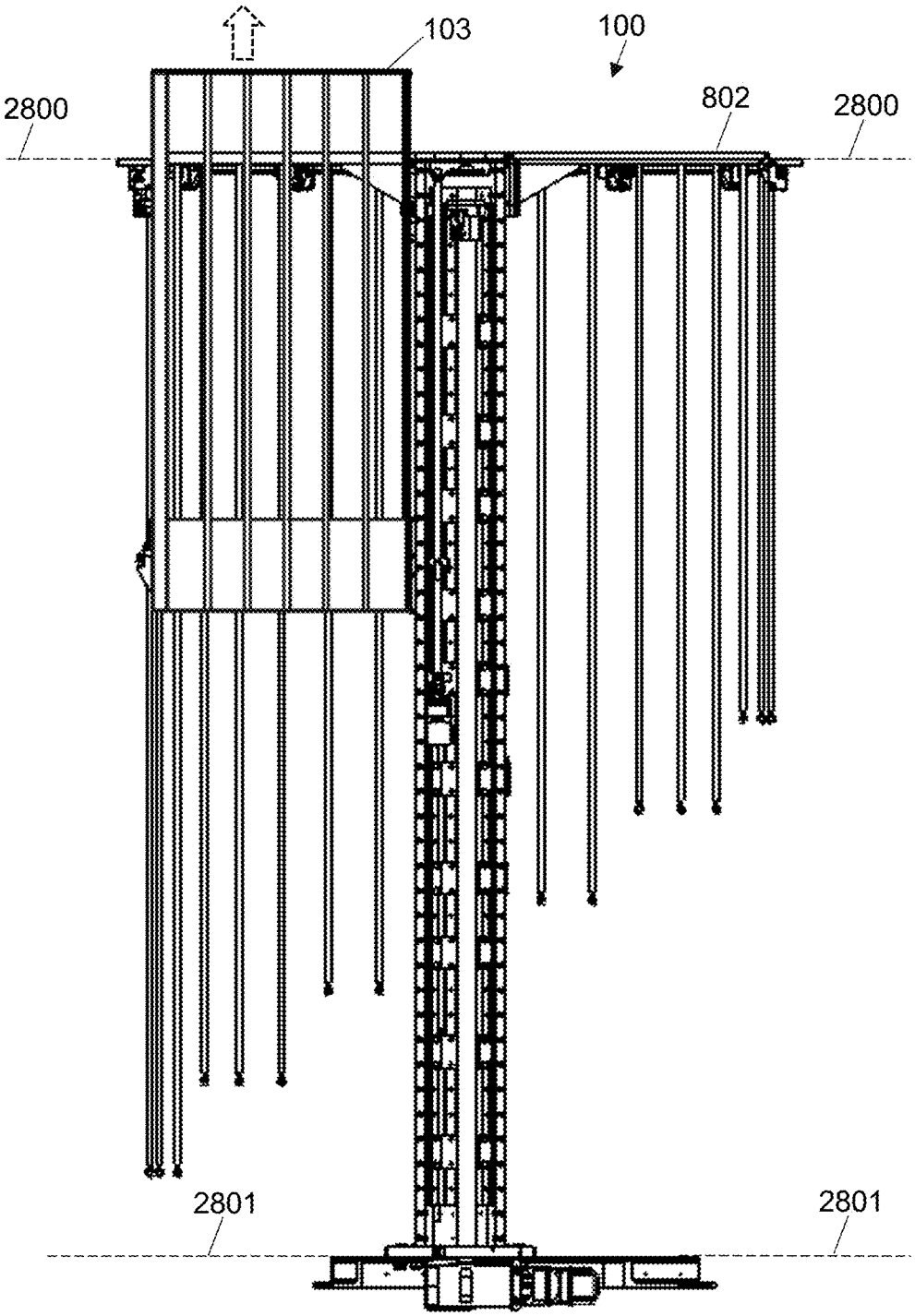
FIG. 28 illustrates a front view cross section of the staircase 100 of FIG. 1A when in a state where the landing barrier is being raised above the flooring surface of the upper floor, according to an embodiment.

In response to the user command or event to transition to the opened state, the landing barrier 103 can be configured to raise above the flooring surface of the upper floor. FIG. 28 illustrates a front view cross section of the staircase 100 of FIG. 1A when in a state where the landing barrier is being raised above the flooring surface of the upper floor, according to an embodiment. In FIG. 28, the landing barrier 103 of the staircase 100 is raised above the upper floor, as represented by the dotted arrow. The flooring surfaces of the upper floor and the lower floor are represented by dotted lines 2800 and 2801, respectively. To raise the landing barrier 103, the linear actuator 123 is activated to move traveling member 127 toward the upper end 116 of the column 101. The landing barrier 103 is raised above the flooring surface 2800 to serve as a safety barrier for entry into the staircase 100 from the upper floor. In FIG. 28, the tread surfaces 802 are shown raised slightly above the flooring surface to allow the latching members 2103,2203 to retract. The timing of when the landing barrier 103 is raised can vary in different implementations (e.g., simultaneous to, before, or after the raising of the steps 102 off of the latching members 2103,2203), but should not be so early as to cause the landing barrier 103 to trigger the unlatching of the latching members 2103,2203 before the steps 102 have been raised enough to create adequate space for the latching members 2103,2203 to retract. For embodiments where the wall barrier 2300 is implemented, the wall barrier 2300 should be rotated in alignment with the landing barrier 103 before the landing barrier 103 is raised so that the landing barrier 103 can enter the coupling channel 2306 of the wall barrier 2300.

The landing barrier 103 is raised until the latch triggering member 1004 on the landing barrier 103 contacts and fully engages the latch actuator 114 to unlatch the latching members 2103,2203. In an embodiment, the computer system 2501 and the landing barrier control system 2504 can be programmed to raise the landing barrier 103 until the latch triggering member 1004 on the landing barrier 103 contacts and fully engages the latch actuator 114. The height (or distance) in which the landing barrier 103 raises out of the floor can vary in different embodiments and can depend on various factors, such as height of the landing barrier, height of the ceiling in the upper floor, desired height, safety standards and regulations, etc. Example heights in which the landing barrier 103 raises can include, but is not limited to, heights in the range of 30 inches to 84 inches from the flooring surface of the upper floor, such as 36 inches to 50 inches. In one implementation, the height in which the landing barrier 103 raises is approximately 42 inches.

Figure 29:
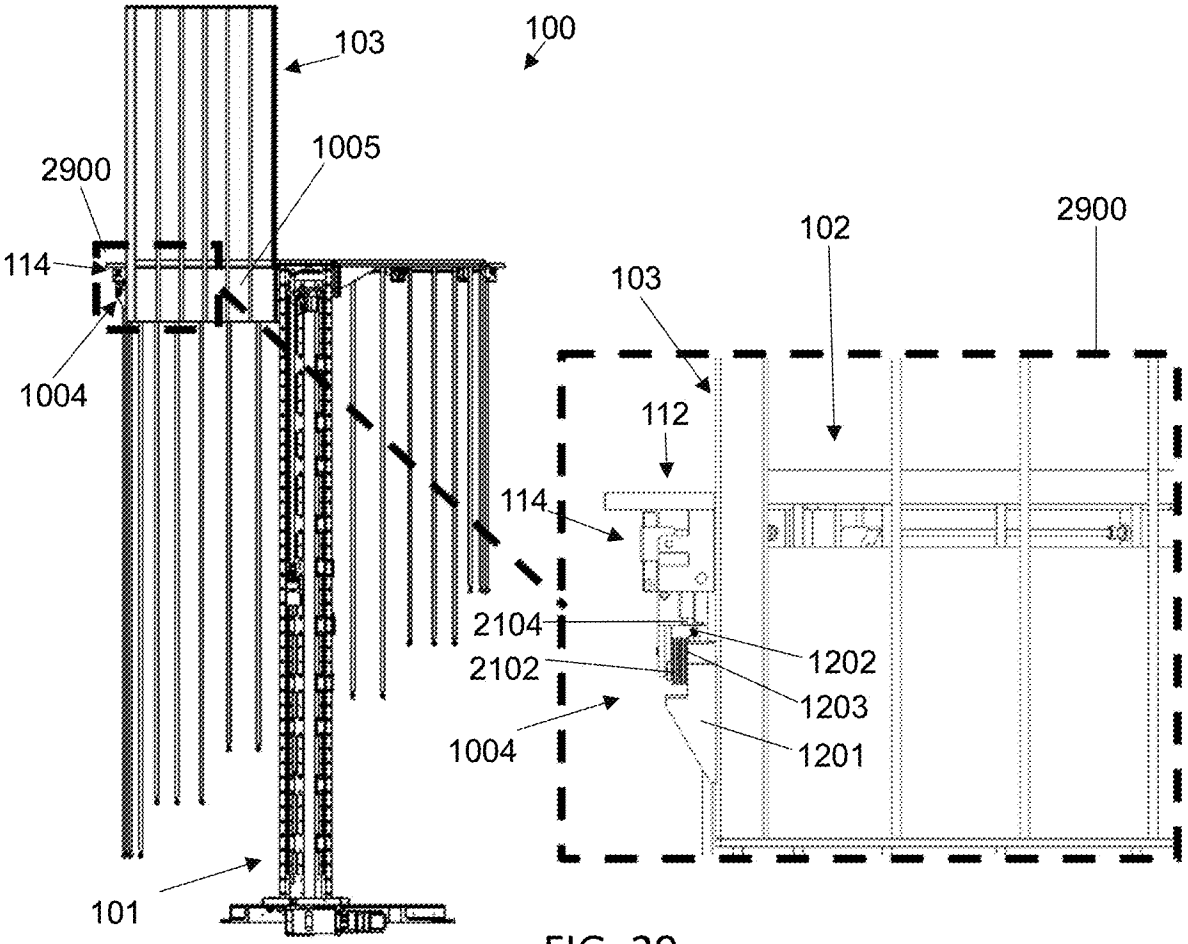
FIG. 29 illustrates a close-up portion of a front view cross section of the staircase 100 of FIG. 1A when in a state where the latch triggering member 1004 is fully engaged with the latch actuator 114, according to an embodiment.

FIG. 29 illustrates a close-up portion of a front view cross section of the staircase 100 of FIG. 1A when in a state where the latch triggering member 1004 is fully engaged with the latch actuator 114, according to an embodiment. In FIG. 29, a close-up portion of the cross section of the staircase 100 is shown and represented by dotted boxes 2900. As shown in portion 2900, the latch triggering member 1004 is contacting the latch actuator 114 that is coupled to the perimeter base 112. The spring plunger 1202 has contacted and pushed the trigger plate 2104 on the latch actuator 114 so that the latching members 2103 (not shown in FIG. 29) on the latch actuator 114 are retracted and unlatched, as previously described for FIGS. 21A and 21B. Furthermore, the pulley 1203 has contacted and pulled the cable 2109 (not shown in FIG. 29) up between the pulleys 2102 to retract and unlatch the latching members 2203 (not shown in FIG. 29) on the latches 115, as previously described for FIG. 22. As shown in FIG. 29, the steps 102 are still raised to provide space for the latching members 2103,2203 to retract. In this state, the landing barrier 103 is fully raised and extending into the upper floor to serve as a safety barrier. In the embodiment shown, a portion of the landing barrier 103 with the plate 1005 remains below the perimeter base 112 and can increase stiffness and support to the landing barrier 103.

For embodiments where the wall barrier 2300 is implemented, when the landing barrier 103 is raised up the column 101, the landing barrier 103 enters and moves within the coupling channel 2306 on the wall barrier 2300. With the landing barrier 103 coupled within the coupling channel 2306, the wall barrier 2300 and the landing barrier 103 can form a safety barrier that ensures users enter the staircase 100 to the proper side of the landing barrier 103.

Figure 30:
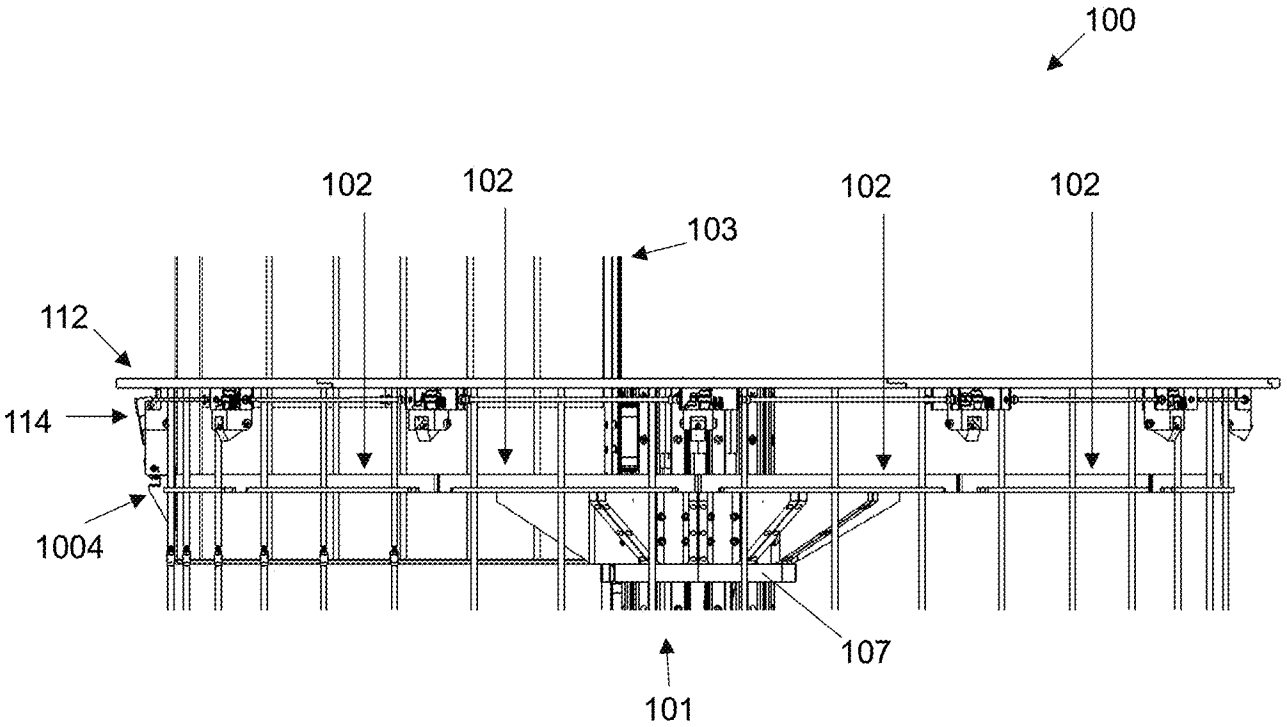
FIG. 30 illustrates a portion of a front view of the staircase 100 of FIG. 1A when in a state where the steps 102 are initially being lowered down the column 101 after the latch actuator 114 and the latches 115 are unlatched to transition from the closed state to the opened state, according to an embodiment.
Figure 31:
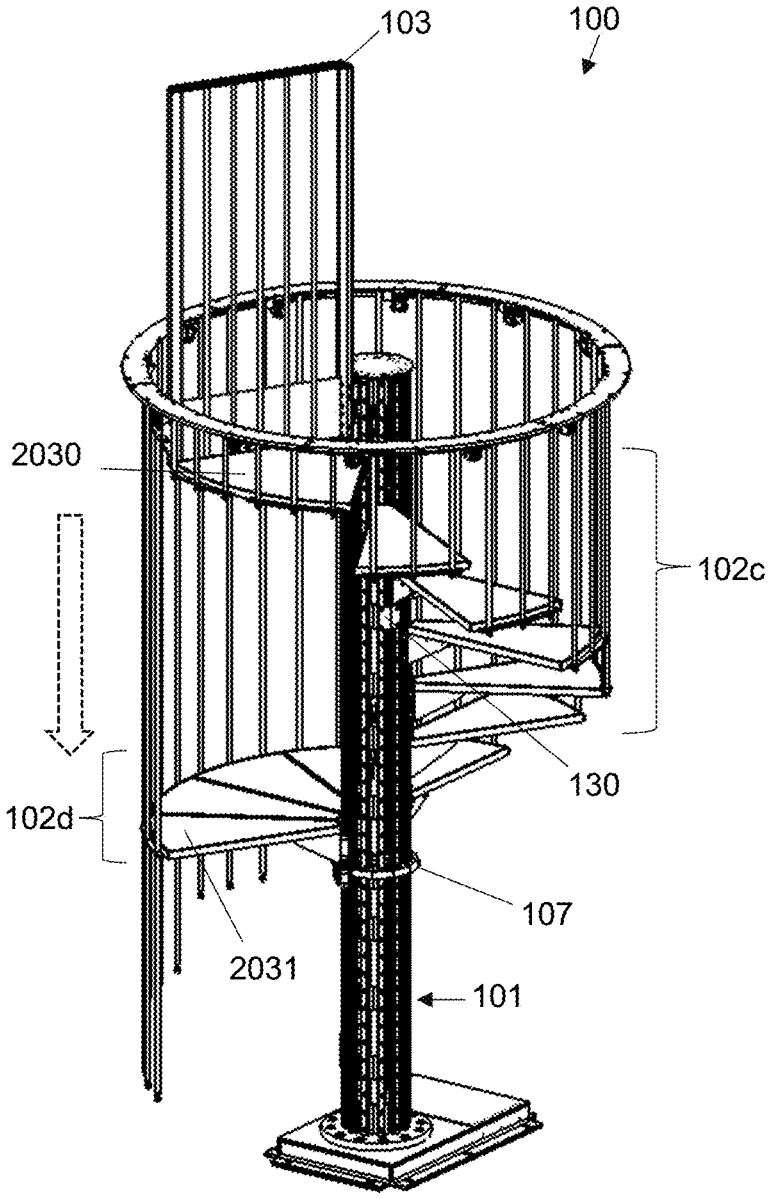
FIG. 31 illustrates a perspective view of the staircase 100 of FIGS. 1A and 1B when in a state where a portion of the steps 102 have been stopped by the hard stops 130 on the column 101, according to an embodiment.

Once the latching members 2103,2203 have been retracted and unlatched, the linear actuator 122 is activated to move the lifting platform 107 down the column 101 (or toward the lower end 117 of the column 101) so that the steps 102 begin to lower down the column 101. As the steps 102 are lowered, the elongated members 113 slide through the holes 804 of the steps 102. The steps 102 will be lowered down the column until each of the steps 102 are stopped by the hard stop 130 on their corresponding linear guide 106 in which they are coupled. In an embodiment, the computer system 2501 and the lifting platform control system 2505 can be programmed to activate the linear actuator 122 to lower the steps 102 down the column 101. FIG. 30 illustrates a portion of a front view of the staircase 100 of FIG. 1A when in a state where the steps 102 are starting to lower down the column 101 after the latch actuator 114 and the latches 115 are unlatched to transition from the closed state to the opened state, according to an embodiment. In FIG. 30, the steps 102 are shown lowered partially down the column 101 by the lifting platform 107. All of the steps 102 are lowered down the column 101 together with each steps 102 being lowered down the linear guide 106 in which it is coupled. As the steps 102 are lowered down the column 101, each step 102 will eventually contact, and be stopped by, one the hard stops 130 coupled to outside of the linear guides 106, as shown in FIG. 31. In this way, the steps 102 cascade down the column 101 from the closed state position to the open state position. The hard stops 130 are positioned on the linear guides 106 at varying distances from the upper end 116 of the column 101 so as to form spiraling steps around the column 101 between the upper floor and the lower floor. The length of the elongated members 113 are such that the stop elements 2004 positioned at the distal end of the elongated members 113 allow the steps 102 to reach their respective hard stop 130 but also prevent the elongated members 113 from being removed from the holes 804 in the steps 102. Furthermore, the length of the elongated members 113 can be set so that the stop elements 2004 abut the outer perimeter of the steps 102 when the steps 1021 are stopped by the hard stops 130. In this way, the stop elements 2004 and the elongated members 113 can provide additional support to the outer perimeter of the steps 102. FIG. 31 illustrates a perspective view of the staircase 100 of FIGS. 1A and 1B when in a state where a portion of the steps 102 have been limited by the hard stops 130 on the column 101, according to an embodiment. In FIG. 31, the steps 102 of the staircase 100 are being lowered down the column 101, as represented by the dotted arrow. A portion of the steps 102 (indicated by reference numeral 102*c*) is limited along the column 101 by the hard stops 130 on the linear guides 106. Another portion of the steps 102 (indicated by reference numeral 102*d*) is still being lowered down the column 101 together by the lifting platform 107 as they have not yet contacted the hard stops 130 on their corresponding linear guides 106. The initial step 2030 is included in the portion 102*c* and is shown as the first step that is limited by one of the hard stops 130. The initial step 2030 is limited at a position where the tread surface 802 is aligned with (or at the approximate height as) the bottom of the landing barrier 103. The final step 2031 is included in the portion 102*d* and shown as the last step that will be limited by one of the hard stops 130.

When the final step 2031 has been limited along the column 101 by one of the hard stops 130, the staircase 100 is in the opened state. In this state, steps 102 form spiraling steps around the column 101 between the upper floor and the lower floor, as shown in FIGS. 1B and 23D. The stop elements 2004 of the elongated members 113 can abut the outer perimeter of the steps 102 and provide additional support to the outer perimeter of the steps 102. The landing barrier 103 (and the wall barrier 2300 if implemented, such as in FIG. 23D) serves as a safety barrier to facilitate proper entry into the staircase 100 from the upper floor. It should be appreciated that in embodiments without the wall barrier 2300 implemented, additional railings can be installed (e.g., around the perimeter base) based on the design of the upper floor to prevent anybody improperly entering the staircase 100 and falling through the perimeter base 112.

When a user wants the staircase 100 to return to the closed state, the user can initiate the closing of the staircase 100 by executing a corresponding user command or event via the user device (e.g., touchscreen display, switch, button, lever, etc.) for the control system 2506. Once the transition to the closed state has been initiated by the user, the process described above can be reversed to bring the staircase back into the closed state.

In an embodiment, the staircase 100 can transition automatically (e.g., automatically cascade) from the closed state to the open state in response to a single user command or event initiated by the user, and vice versa. As previously stated, the sequence in which the staircase 100 transitions between states (e.g., from the closed state to the opened state, and vice versa) can vary in different embodiments and one or more operations can be performed at various times, such as in parallel. In one embodiment, for example, the staircase 100 is configured to automatically transition from the closed state to the opened state in response to a corresponding user command or event, as indicated by the following sequence: the steps 102 are raised from the closed state position to provide space for the latching members to retract on the latch actuator 114 and the latches 115; the wall barrier 2300 is rotated to align with the landing barrier 103; the landing barrier 103 is raised above the upper floor; the latching members retract on the latch actuator 114 and the latches 115; and, the steps 102 are lowered by the lifting platform 107 until they are positioned in the opened state position. The sequence can be reversed when the staircase 100 automatically transitions from the opened state to the closed state in response to a corresponding user command or event.

In embodiments of the staircase 100 where a sensor system is implemented (e.g., the staircase 100 of FIG. 24 including the upper and lower light curtains 2401,2402), if someone enters the area of the staircase when the staircase is transitioning between the closed and opened states, the staircase 100 can be configured to stop any movement until the area is cleared. In some instances, the staircase 100 can be configured to perform another suitable safety procedure if someone enters the area of the staircase when the staircase is transitioning. For example, if the staircase is transitioning from the closed state to the opened state and someone is detected in the area monitored by the lower light curtain 2402, the staircase 100 can be programmed to return to the closed state. As another example, the staircase 100 may be programmed to prevent the staircase 100 from initiating any transition (e.g., from the closed state to the opened state, or vice versa) if someone is detected in an unsafe area or zone being monitored by the sensor system. In an embodiment, the computer system 2501 and the sensor control system 2503 can be programmed to monitor the area of the staircase 100 and perform any safety procedure implemented if necessary.

It should be appreciated that variations of the embodiments described herein may be implemented without compromising the underlying principles of the disclosure. For example, in another embodiment, two or more staircases 100 can be implemented over three or more floors to create a flight of stairs over more than two floors. As another example, the staircase 100 can be implemented in another embodiment to work in conjunction with fixed steps on the lower floor. In such case, for instance, the lower floor can include fixed stairs near the lower end 117 of the column. The fixed stairs can include fixed steps that lead only partially up toward the upper floor. In such case, that the steps 102 of the staircase 100 can be configured to lower down the column 101 until the fixed steps are reached. In this way, the fixed steps and the steps 102 (when in the opened state) together provide the necessary steps for users to go between the upper and lower floors.

Throughout the foregoing description, and for the purposes of explanation, numerous specific details are set forth in order to provide a thorough understanding of the described techniques. It will be apparent, however, to one skilled in the art that these techniques can be practiced without some of these specific details. Although various embodiments that incorporate these teachings have been shown and described in detail, those skilled in the art could readily devise many other varied embodiments or mechanisms to incorporate these techniques. Also, embodiments can include various operations as set forth above, fewer operations, or more operations, or operations in another order. Accordingly, the scope and spirit of the invention should only be judged in terms of any accompanying claims that may be appended, as well as any legal equivalents thereof.

Reference throughout the specification to "one embodiment" or "an embodiment" is used to mean that a particular feature, structure or characteristic described in connection with an embodiment is included in at least one embodiment. Thus, the appearance of the expressions "in one embodiment" or "in an embodiment" in various places throughout the specification are not necessarily referring to the same embodiment. Further, the particular features, structures or characteristics may be combined in any suitable manner in one or several embodiments. Although the present invention has been described above with reference to specific embodiments, it is not intended to be limited to the specific form set forth herein. Rather, embodiments other than those specific described above are equally possible within the scope of any accompanying claims. Moreover, it should be appreciated that the terms "comprise/comprises" or "include/includes", as used herein, do not exclude the presence of other elements or steps. Furthermore, although individual features may be included in different claims, these may possibly advantageously be combined, and the inclusion of different claims does not imply that a combination of features is not feasible and/or advantageous. In addition, singular references do not exclude a plurality. Finally, reference signs in the claims are provided merely as a clarifying example and should not be construed as limiting the scope of the claims in any way.

What is claimed is:

1. A staircase for traversing between an upper floor and a lower floor, the staircase comprising:

a column having an upper end configured for positioning at the upper floor, a lower end configured for positioning at the lower floor, and an interior area;

a plurality of steps coupled to the column, wherein each step of the plurality of steps:

is coupled to the column and extends outside of, and away from, the column;

comprises a respective tread surface; and is configured to move longitudinally along the column;

wherein the staircase is configured to transition to a plurality of states by an actuation system during operation, the plurality of states comprising a closed state and an opened state;

wherein the closed state comprises the plurality of steps positioned at the upper end of the column with the tread surfaces of the plurality of steps oriented around the upper end of the column and configured to be coplanar to a flooring surface of the upper floor;

wherein the opened state comprises the plurality of steps positioned at varying distances longitudinally along the column from the upper end towards the lower end so as to form spiraling steps around the column between the upper and lower floors; and wherein the plurality of steps is configured to move longitudinally along the column for positioning in the closed and opened states; and a lifting platform, wherein the lifting platform comprises:

a coupling portion for coupling to the actuation system, wherein the coupling portion is positioned in the interior area of the column;

a contacting portion for contacting and moving the plurality of steps longitudinally along the column, wherein the contacting portion is positioned outside of the column and below the plurality of steps; and one or more spokes extending from the coupling portion to the contacting portion;

wherein each of the one or more spokes extend through the column; and wherein the lifting platform is configured to move longitudinally along the column to contact and move the plurality of steps along the column.

2. The staircase of claim 1, further comprising a plurality of linear guides coupled together to form the column, wherein the interior area is between the plurality of linear guides, wherein the plurality of linear guides extends longitudinally between the upper and lower ends of the column, wherein the plurality of steps are coupled to the plurality of linear guides, and wherein each step of the plurality of steps:

is coupled to a respective linear guide of the plurality of linear guides and extends outside of, and away from, the respective linear guide; and is configured to move longitudinally along the respective linear guide;

wherein the opened state comprises the plurality of steps positioned at varying distances longitudinally along the plurality of linear guides from the upper end of the column towards the lower end of the column so as to form spiraling steps around the column between the upper floor and the lower floor; and wherein the plurality of steps is configured to move longitudinally along the plurality of linear guides for positioning in the closed and opened states.

3. The staircase of claim 2, wherein the plurality of linear guides comprises a plurality of subsets of linear guides that form segments of the column, wherein each subset of the plurality of subsets of linear guides comprises more than one linear guide coupled together by coupling elements positioned in the interior area of the column, and wherein the staircase further comprises:

an upper housing positioned in the interior area of the column and coupled to the plurality of subsets of linear guides at the upper end of the column; and a lower housing positioned in the interior area of the column and coupled to the plurality of subsets of linear guides at the lower end of the column;

wherein the plurality of subsets of linear guides are coupled together by the upper and lower housings such that gaps are formed between adjacent segments of the column, the gaps extending longitudinally along the adjacent segments between the upper and lower housings.

4. The staircase of claim 3, wherein the lifting platform comprises the contacting portion for contacting and moving the plurality of steps longitudinally along the plurality of linear guides;

wherein each of the one or more spokes extend through a respective one of the gaps formed between the adjacent segments of the column;

wherein the lifting platform is configured to move longitudinally along the column to contact and move the plurality of steps longitudinally along the plurality of linear guides so as to lift and lower the plurality of steps along the column; and wherein each of the one or more spokes are configured to move within the respective one of the gaps formed between the adjacent segments when the lifting platform moves longitudinally along the column.

5. The staircase of claim 4, further comprising:

a plurality of stop elements for contacting the plurality of steps to limit movement of the plurality of steps longitudinally along the plurality of linear guides toward the lower end of the column, wherein the plurality of events are coupled to the plurality of linear guides and positioned on an exterior side of the column such that the movement of the plurality of steps along the plurality of linear guides toward the lower end of the column is limited at the varying distances that form the spiraling steps around the column; and a first linear actuator for moving the lifting platform longitudinally along the column, wherein the actuation system comprises the first linear actuator, wherein the first linear actuator is coupled to the upper housing and comprises a first traveling member, and wherein the first traveling member is coupled to the coupling portion of the lifting platform and configured to move longitudinally within the interior area of the column so as to move the lifting platform longitudinally along the column.

6. The staircase of claim 5, further comprising:

a landing barrier coupled to one of the plurality of linear guides and positioned outside of the column; and a second linear actuator for moving the landing barrier longitudinally along the column, wherein the actuation system comprises the second linear actuator;

wherein the second linear actuator is coupled to the upper housing and comprises a second traveling member, wherein the second traveling member is configured to extend through one of the gaps formed between the adjacent segment, wherein the second traveling member is coupled to the landing barrier and configured to move longitudinally along the column so as to move the landing barrier longitudinally along the column, wherein the closed state further comprises the landing barrier positioned below the upper floor, and wherein the opened state further comprises the landing barrier positioned above the upper floor so as to:

enable entry into the staircase from the upper floor in a direction of the spiraling steps around the column; and prevent entry into the staircase from the upper floor in a direction opposite of the spiraling steps around the column.

7. The staircase of claim 6, further comprising:

an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state;

a latch actuator and a plurality of latches coupled to the perimeter base, wherein the latch actuator and the plurality of latches are positioned around the perimeter base, and wherein the latch actuator and the plurality of latches comprises:

a latched state that secures the plurality of steps in position in the closed state; and an unlatched state that enables the plurality of steps to transition from the closed state to the opened state; and a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state; and a wall barrier configured to rotate toward and couple to the landing barrier when the staircase enters the opened state to serve as a safety barrier extending from the landing barrier to a nearby wall when the staircase is in the opened state, wherein the closed state further comprises the wall barrier positioned against or within a nearby wall, and wherein the open state further comprises the wall barrier positioned to align with the landing barrier and couple to the landing barrier.

8. The staircase of claim 2, wherein the lifting platform comprises the contacting portion for contacting and moving the plurality of steps longitudinally along the plurality of linear guides;

wherein the lifting platform is configured to move longitudinally along the column to contact and move the plurality of steps longitudinally along the plurality of linear guides so as to lift and lower the plurality of steps along the column.

9. The staircase of claim 2, further comprising:

a landing barrier coupled to one of the plurality of linear guides and positioned outside of the column; and a linear actuator for moving the landing barrier longitudinally along the column, wherein the actuation system comprises the linear actuator;

wherein the linear actuator is coupled to the column, positioned within the column, and comprises a traveling member, wherein the traveling member is configured to extend through the column, wherein the traveling member is coupled to the landing barrier and configured to move longitudinally along the column so as to move the landing barrier longitudinally along the column, wherein the closed state further comprises the landing barrier positioned below the upper floor, and wherein the opened state further comprises the landing barrier positioned above the upper floor so as to:

enable entry into the staircase from the upper floor in a direction of the spiraling steps around the column; and prevent entry into the staircase from the upper floor in a direction opposite of the spiraling steps around the column.

10. The staircase of claim 2, further comprising an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a latch actuator and a plurality of latches coupled to the perimeter base, wherein the latch actuator and the plurality of latches are positioned around the perimeter base, and wherein the latch actuator and the plurality of latches comprise:

a latched state that secures the plurality of steps in position in the closed state; and an unlatched state that enables the plurality of steps to transition from the closed state to the opened state.

11. The staircase of claim 2, further comprising an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state.

12. The staircase of claim 1, further comprising a landing barrier coupled to the column, wherein the closed state further comprises the landing barrier positioned below the upper floor, and wherein the opened state further comprises the landing barrier positioned above the upper floor so as to:

enable entry into the staircase from the upper floor in a direction of the spiraling steps around the column; and prevent entry into the staircase from the upper floor in a direction opposite of the spiraling steps around the column.

13. The staircase of claim 1, further comprising an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a latch actuator and a plurality of latches coupled to the perimeter base, wherein the latch actuator and the plurality of latches are positioned around the perimeter base, and wherein the latch actuator and the plurality of latches comprise:

a latched state that secures the plurality of steps in position in the closed state; and an unlatched state that enables the plurality of steps to transition from the closed state to the opened state.

14. The staircase of claim 1, further comprising an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state.

15. A staircase for traversing between an upper floor and a lower floor, the staircase comprising:

a column having an upper end configured for positioning at the upper floor, a lower end configured for positioning at the lower floor, and an interior area;

a plurality of steps coupled to the column, wherein each step of the plurality of steps:

is coupled to the column and extends outside of, and away from, the column;

comprises a respective tread surface; and is configured to move longitudinally along the column;

wherein the staircase is configured to transition to a plurality of states by an actuation system during operation, the plurality of states comprising a closed state and an opened state;

wherein the closed state comprises the plurality of steps positioned at the upper end of the column with the tread surfaces of the plurality of steps oriented around the upper end of the column and configured to be coplanar to a flooring surface of the upper floor;

wherein the opened state comprises the plurality of steps positioned at varying distances longitudinally along the column from the upper end towards the lower end so as to form spiraling steps around the column between the upper and lower floors; and wherein the plurality of steps is configured to move longitudinally along the column for positioning in the closed and opened states; and a landing barrier coupled to the column, wherein the closed state further comprises the landing barrier positioned below the upper floor, and wherein the opened state further comprises the landing barrier positioned above the upper floor so as to:

enable entry into the staircase from the upper floor in a direction of the spiraling steps around the column; and prevent entry into the staircase from the upper floor in a direction opposite of the spiraling steps around the column.

16. The staircase of claim 15, further comprising an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state;

a latch actuator and a plurality of latches coupled to the perimeter base, wherein the latch actuator and the plurality of latches are positioned around the perimeter base, and wherein the latch actuator and the plurality of latches comprise:

a latched state that secures the plurality of steps in position in the closed state; and an unlatched state that enables the plurality of steps to transition from the closed state to the opened state; and a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state.

17. The staircase of claim 15, further comprising a wall barrier configured to rotate toward and couple to the landing barrier when the staircase enters the opened state to serve as a safety barrier extending from the landing barrier to a nearby wall when the staircase is in the opened state, wherein the closed state further comprises the wall barrier positioned against or within a nearby wall, and wherein the open state further comprises the wall barrier positioned to align with the landing barrier and couple to the landing barrier.

18. The staircase of claim 15, further comprising:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state.

19. A staircase for traversing between an upper floor and a lower floor, the staircase comprising:

a column having an upper end configured for positioning at the upper floor, a lower end configured for positioning at the lower floor, and an interior area;

a plurality of steps coupled to the column, wherein each step of the plurality of steps:

is coupled to the column and extends outside of, and away from, the column;

comprises a respective tread surface; and is configured to move longitudinally along the column;

wherein the staircase is configured to transition to a plurality of states by an actuation system during operation, the plurality of states comprising a closed state and an opened state;

wherein the closed state comprises the plurality of steps positioned at the upper end of the column with the tread surfaces of the plurality of steps oriented around the upper end of the column and configured to be coplanar to a flooring surface of the upper floor;

wherein the opened state comprises the plurality of steps positioned at varying distances longitudinally along the column from the upper end towards the lower end so as to form spiraling steps around the column between the upper and lower floors; and wherein the plurality of steps is configured to move longitudinally along the column for positioning in the closed and opened states; and an outer perimeter assembly, wherein the outer perimeter assembly comprises:

a perimeter base having a top surface, wherein the perimeter base is configured to be positioned in the upper floor such that the top surface is coplanar with the flooring surface of the upper floor, and wherein the perimeter base is oriented around an outer perimeter of the plurality of steps such that the top surface is coplanar with the tread surfaces of the plurality of steps when the staircase is in the closed state; and a latch actuator and a plurality of latches coupled to the perimeter base, wherein the latch actuator and the plurality of latches are positioned around the perimeter base, and wherein the latch actuator and the plurality of latches comprise:

a latched state that secures the plurality of steps in position in the closed state; and an unlatched state that enables the plurality of steps to transition from the closed state to the opened state.

20. The staircase of claim 19, wherein the outer perimeter assembly further comprises a plurality of elongated members coupled to the perimeter base and configured to extend longitudinally from the perimeter base toward the lower floor, wherein the plurality of elongated members is configured to couple to the outer perimeter of the plurality of steps such that the plurality of steps are movable longitudinally along the column for positioning in the closed and opened states, and wherein the plurality of elongated members is positioned around the perimeter base and around the outer perimeter of the plurality of steps so as to form a side barrier around the outer perimeter of the spiraling steps when the staircase is in the opened state.

* * * * *